US008295733B2

(12) United States Patent
Imoto

(10) Patent No.: US 8,295,733 B2
(45) Date of Patent: Oct. 23, 2012

(54) IMAGE FORMING APPARATUS, BELT UNIT, AND BELT DRIVING CONTROL METHOD

(75) Inventor: Shinji Imoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 958 days.

(21) Appl. No.: 12/209,846

(22) Filed: Sep. 12, 2008

(65) Prior Publication Data

US 2009/0074461 A1 Mar. 19, 2009

(30) Foreign Application Priority Data

Sep. 13, 2007 (JP) ..... 2007-237644
Sep. 8, 2008 (JP) ..... 2008-229663

(51) Int. Cl.
*G03G 15/00* (2006.01)
*G03G 15/01* (2006.01)

(52) U.S. Cl. ..... 399/165; 399/302

(58) Field of Classification Search ..... 399/165, 399/302

See application file for complete search history.

(56) References Cited

U.S. PATENT DOCUMENTS

| | | | | |
|---|---|---|---|---|
| 6,941,096 | B2 * | 9/2005 | Matsuda et al. | 399/167 |
| 7,334,858 | B2 | 2/2008 | Kogure et al. | |
| 2003/0223768 | A1 | 12/2003 | Takigawa | |
| 2006/0055754 | A1 | 3/2006 | Sakuma et al. | |
| 2006/0164491 | A1 | 7/2006 | Sakuma et al. | |
| 2006/0182471 | A1 | 8/2006 | Okamura et al. | |
| 2007/0103532 | A1 | 5/2007 | Imoto et al. | |
| 2007/0109385 | A1 | 5/2007 | Imoto et al. | |
| 2007/0126837 | A1 | 6/2007 | Takahashi et al. | |
| 2007/0291084 | A1 | 12/2007 | Hayashi | |
| 2008/0145123 | A1 | 6/2008 | Kogure et al. | |

FOREIGN PATENT DOCUMENTS

| | | | |
|---|---|---|---|
| EP | 1684127 | A1 | 7/2006 |
| EP | 1785280 | A1 | 5/2007 |
| JP | 63051242 | A * | 3/1988 |
| JP | 5-319610 | | 12/1993 |
| JP | 2918905 | | 4/1999 |
| JP | 2000-310897 | | 11/2000 |
| JP | 2000-330353 | | 11/2000 |
| JP | 3186610 | | 5/2001 |
| JP | 2004-123383 | | 4/2004 |
| JP | 2006-36513 | | 2/2006 |
| JP | 2006-131353 | | 5/2006 |
| JP | 2006-235560 | | 9/2006 |
| JP | 2006-264976 | | 10/2006 |
| JP | 2007-8093 | | 1/2007 |

OTHER PUBLICATIONS

U.S. Appl. No. 11/662,616, filed Mar. 12, 2007.
Apr. 21, 2011, European search report in connection with counterpart European patent application No. 08 253 014.8.

* cited by examiner

*Primary Examiner* — David Gray
*Assistant Examiner* — Erika J Villaluna
(74) *Attorney, Agent, or Firm* — Cooper & Dunham LLP

(57) ABSTRACT

An image forming apparatus for forming an image on a recording medium includes a belt configured to travel rotationally and looped around at least two rotary support members, a driven rotary member disposed facing at least one of the rotary support members via the belt and configured to rotate with the belt, and a controller. The controller is configured to minimize fluctuation in one of a travel velocity and a travel distance of the belt by controlling the travel of the belt based on one of a rotational angular displacement and a rotational angular velocity of each of the rotary support member and the driven rotary member.

18 Claims, 12 Drawing Sheets

IMAGE FORMING APPARATUS, BELT UNIT, AND BELT DRIVING CONTROL METHOD

BACKGROUND OF THE INVENTION

1. Field of the Invention

The present invention generally relates to an image forming apparatus and a belt unit.

2. Discussion of the Background

In general, an electrophotographic image forming apparatus, for example, a printer, a facsimile machine, a copier, a multifunction machine including at least two of these functions, etc., includes an image forming mechanism for forming an electrostatic latent image, developing the latent image with toner, and transferring the toner image onto a recording medium. The image forming apparatus further includes various movable belts including a photoreceptor belt, an intermediate transfer belt, a sheet transport belt, etc.

It is to be noted that "image forming" includes both forming on a recording medium an image including a pattern, etc., that has no commonly understood meaning as well as an image including a letter and/or an illustration that does have a given meaning. Thus, printing, imaging, recording, pattern forming, applying a material having a given function to a given position of a recording medium are synonymous with "image forming" in the descriptions below.

For example, a tandem image forming apparatus employing a direct transfer method includes a transport belt for transporting a recording medium and multiple image forming units for forming different color images (single color images) located along a direction in which the recording medium is transported. While the recording medium is transported through the image forming units, the different color images are superimposed one on another on the recording medium, forming a multicolor image thereon.

In another example, an inkjet image forming apparatus includes a recording head that applies different color ink droplets onto a recording medium in order to form a multicolor image thereon while a transport belt transports the recording medium.

In the image forming apparatuses described above, it is necessary to control travel of such movable belts accurately in order to prevent image failure such as color deviation, which means that the different color images are not properly aligned in the multicolor image.

In particular, travel velocity of the belts can fluctuate depending on various factors such as unevenness of belt thickness. For example, when a belt is produced through centrifugal burning using a cylindrical mold, its thickness may be uneven.

If the thickness of the belt is uneven, the belt moves faster when its thicker portion is on a driving roller and slower when its thinner portion is on the driving roller, thus causing its travel velocity to fluctuate. Fluctuation in travel velocity of the belt is described in detail below.

FIG. 16 illustrates an example of unevenness (or deviational distribution) in the circumferential direction of the thickness of the intermediate transfer belt (hereinafter simply "belt thickness") used in the tandem image forming apparatus described above.

In FIG. 16, a horizontal axis shows a position on the intermediate transfer belt (belt position) in the circumferential direction when its circumferential length is shown as angle of $2\pi$ radian (rad). A vertical axis shows a deviation of the belt thickness in a circumferential direction from an average thickness of 100 μm, which is indicated as 0 in FIG. 16.

The deviational distribution of the belt thickness in a circumferential direction is also referred to as fluctuation in the belt thickness.

Here, "belt thickness unevenness" means deviational distribution of the belt thickness, as measured by a film thickness gauge, etc. The belt thickness can be uneven in either the circumferential direction in which the belt travels or a width direction, which is an axial direction of the roller and perpendicular to the direction in which the belt travels. By contrast, "belt thickness fluctuation" means another deviational distribution of the belt thickness that is caused by fluctuation in rotation cycle of the belt, and affects the travel velocity of the belt relative to a rotation velocity of the driving roller as well as a travel velocity of a driven roller relative to the travel velocity of the belt when the belt is mounted on a belt driving controller.

FIG. 17 illustrates a portion of a belt 1003 that is wound around a driving roller 1001, viewed from an axial direction of the driving roller 1001.

A travel velocity of the belt 1003 is determined based on a distance between a surface of the driving roller 1001 (hereinafter "roller surface") and a belt pitch line, which is hereinafter referred to as a pitch line distance (PLD). The pitch line distance corresponds to a distance between a center of the belt in a thickness direction and its inner surface, in other words, the roller surface, provided that the belt 1003 is a uniform single-layer belt and absolute values of degrees of expansion of its inner surface and its outer surface are substantially similar.

Therefore, if the belt 1003 is single-layered, the relation between the pitch line distance and the belt thickness is substantially constant, and thus the travel velocity of the belt can be determined based on the belt thickness fluctuation.

By contrast, if the belt 1003 is multilayered, a harder layer and a softer layer can have different expansion characteristics, and thus its pitch line distance may differ.

The pitch line distance can be expressed as follows:

$$PLD=PLD_{ave}+f(d) \quad (1)$$

where $PLD_{ave}$ represents an average value of the pitch line distance along the entire circumference of the belt 1003, which is hereinafter referred to as an average pitch line distance, and f(d) represents a function that indicates fluctuations in the pitch line distance in the entire circumference of the belt 1003.

In formula 1 described above, for example, the pitch line distance $PLD_{ave}$ is 50 μm when the belt 1003 is single-layered and its average thickness is 100 μm. The function f(d) is a periodic function whose period corresponds to the circumference of the belt 1003, and is closely related to the deviation in the belt thickness shown in FIG. 16.

When the pitch line distance fluctuates in the circumferential direction, the travel velocity or travel distance of the belt 1003 relative to the rotational angular velocity or rotational displacement of the driving roller 1001 fluctuates, and, alternatively, the rotational angular velocity or rotational displacement of the driven roller 1001 relative to the travel velocity or travel distance of the belt 1003 fluctuates.

The relation between the travel velocity of the belt 1003 and the rotational angular velocity of the driving roller 1001 cab be expressed as:

$$V=\{r+PLD_{ave}+kf(d)\}\omega \quad (2)$$

where V represents the travel velocity of the belt 1003, r represents the radius of the driving roller 1001, ω represents the rotational angular velocity of the driving roller 1001, and k represents a PLD fluctuation effective coefficient.

It is to be noted that the PLD fluctuation effective coefficient k indicates a degree of effect of the pitch line distance fluctuation f(d) on the relations between the travel velocity of the belt 1003 and the rotational angular velocity of the driving roller 1001 or the travel distance of the belt 1003 and the rotational displacement of the driving roller 1001. This degree of effects of the fluctuation f(d) may vary depending on a state of contact between the belt 1003 and the driving roller 1001 or an amount for which the belt 1003 winds around the driving roller 1001.

Hereinafter $r+PLD_{ave}+kf(d)$ is referred to as an effective roller radius, $r+PLD_{ave}$ is referred to as an effective roller radius R, and f(d) is referred to as PLD fluctuation.

From formula 2 shown above, it can be seen that the relation between the travel velocity V of the belt 1003, which is hereinafter simply referred to as the belt travel velocity, and the rotational angular velocity ω of the driving roller 1001 varies depending on the PLD fluctuation f(d). That is, the belt travel velocity V varies depending on the PLD fluctuation f(d) even when the driving roller 1003 rotates at a constant rotational angular velocity (ω is constant).

When the belt 1003 is single-layered and a portion thicker than its average thickness winds around the driving roller 1001, the PLD fluctuation f(d), which is closely correlated with the belt thickness deviation, is a positive value, and thus the effective roller radius increases. Consequently, the belt travel velocity V increases even when the driving roller 1001 rotates at a constant rotational angular velocity.

By contrast, when a portion of the belt 1003 that is thinner than its average thickness winds around the driving roller 1001, the PLD fluctuation f(d) is a negative value, and thus the effective roller radius decreases. Consequently, the belt travel velocity V decreases even when the driving roller 1001 rotates at a constant rotational angular velocity.

Because the belt travel velocity V is not constant due to the PLD fluctuation f(d) even when the rotational angular velocity of the driving roller 1003 is constant as described above, the belt 1003 cannot be controlled to move at a desired travel velocity by adjusting only the rotational angular velocity ω of the driving roller 1001.

Further, relations between the belt travel velocity V and the rotational angular velocity of the driven roller is similar to the relations between the belt travel velocity V and the rotational angular velocity ω of the driving roller 1001. That is, formula 2 shown above can be used as well to calculate the belt travel velocity V based on a rotational angular velocity of the driven roller detected by a rotary encoder.

Therefore, when the belt 1003 is single-layered and a portion that is thicker than its average thickness winds around the driven roller, the PLD fluctuation f(d) is a positive value and thus the effective roller radius increases. Consequently, the rotational angular velocity of the driven roller decreases even when the belt travel velocity V is constant.

By contrast, when a portion of the single-layered belt 1003 that is thinner than its average thickness winds on the driven roller, the PLD fluctuation f(d) is a negative value, and thus the effective roller radius decreases. Consequently, the rotational angular velocity of the driven roller increases even when the belt travel velocity V is constant.

Thus, the travel velocity of the belt 1003 cannot be controlled by adjusting only the rotational angular velocity of the driven roller.

In order to solve the problem described above, there are the belt driving control methods or mechanisms described below, which take the PLD fluctuation f(d) into account.

A known method uses a belt produced through a centrifugal molding method, in which the PLD tends to fluctuate like a sine curve. Before the belt is installed in an apparatus, thickness profile (thickness unevenness) of the belt is measured along its entire circumference in the belt production process, and a velocity profile to cancel such fluctuation as to be caused by the thickness profile is preliminarily measured. Then, a reference position or home position that is used to match a phase of thickness profile data and that of the actual belt thickness unevenness is marked on the belt. Driving of belt is controlled in order to cancel the fluctuation in the belt travel velocity caused by the belt thickness fluctuation by detecting the marked position.

In another known method, a detection pattern is formed on the belt with toner, and periodic fluctuation in the belt travel velocity is detected by detecting the detection pattern with a sensor.

In another known method, a belt is looped around multiple support members including a driving rotary member and a driven rotary member, a rotational angular displacement or rotational angular velocity of the driven rotary member that does not contribute to transmission of rotational driving force is detected, and then an AC (alternating current) component of the rotational angular displacement or rotational angular velocity having a frequency corresponding to the periodic fluctuation in the belt thickness in a circumferential direction is extracted from results of the detection. Rotation of the driving rotary member is controlled based on the phase and amplitude of the AC component.

In a known driving control mechanism, a belt is looped around multiple support members including two rotary members of different diameters and/or that cause the PLDs of portions of the belt winding around thereof to differently affect the relations between the belt travel velocity and the rotational angular velocity thereof. Then, based on information about rotational angular displacement or rotational angular velocity of the two rotary members, rotation of the rotary members is controlled so as to reduce fluctuation in the belt travel velocity caused by the PLD fluctuation in the circumferential direction.

Yet another known driving control mechanism includes a mark detector configured to detect a reference position of a belt, an angular displacement deviation detector configured to detect deviation in angular displacement detected by an encoder, caused by fluctuation in belt thickness, according to an output signal from the mark detector, a first calculator configured to calculate a phase and a maximum amplitude of a distance between the mark and the deviation in the angular displacement, a nonvolatile memory storing results of the calculation generated by the first calculator, a second calculator configured to calculated correction data using values stored in the nonvolatile memory according to the distance from the mark on the belt, and a volatile memory storing the correction data. When the belt is driven, a belt driving member is controlled by adding the correction data to a control target value so as to cancel fluctuation in the belt travel velocity caused by fluctuation in belt thickness.

However, in the method using the belt thickness profile, a belt thickness measurement process is required, which increases the production cost. Further, each time the belt is replaced, the belt thickness profile data of the new belt must be input into the apparatus.

Further, in the method using the detection pattern, consumption of toner is relatively high because the detection pattern is formed on the entire circumference of the belt.

Moreover, in the method using the AC component of the rotational angular displacement or rotational angular velocity of the driven rotary member, although the belt thickness fluctuation is approximated by a sine function or a cosine function, approximating the belt thickness fluctuation to a periodic function is difficult.

SUMMARY OF THE INVENTION

In view of the foregoing, in one illustrative embodiment of the present invention, a belt unit includes a belt configured to travel rotationally and looped around at least two rotary support members, a driven rotary member disposed facing at least one of the rotary support members via the belt and configured to rotate with the belt, and a controller. The controller minimizes fluctuation in one of a travel velocity and a travel distance of the belt by controlling the travel of the belt based on one of a rotational angular displacement and a rotational angular velocity of each of the rotary support member and the driven rotary member.

In another illustrative embodiment of the present invention, an image forming apparatus for forming an image on a recording medium includes the belt unit described above.

Yet another illustrative embodiment of the present invention describes a method of controlling a belt looped around at least two rotary support members. The method includes detecting one of a rotational angular displacement and a rotational angular velocity of one of the rotary support members and a driven rotary member disposed facing one of the rotary support member via the belt and configured to rotate with the belt, evaluating rotational fluctuation information regarding a time period required for the belt to make at least one rotation, extracting AC components whose periods respectively correspond to one rotation of the rotary support member and the driven rotary member and are different from each other from the rotational fluctuation information, evaluating a fluctuation component caused by the belt by deducting the Ac components from the rotational fluctuation information, and minimizing fluctuation in one of a travel velocity and a travel distance of the belt by controlling travel of the belt based on the fluctuation component caused by the belt and the AC components.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
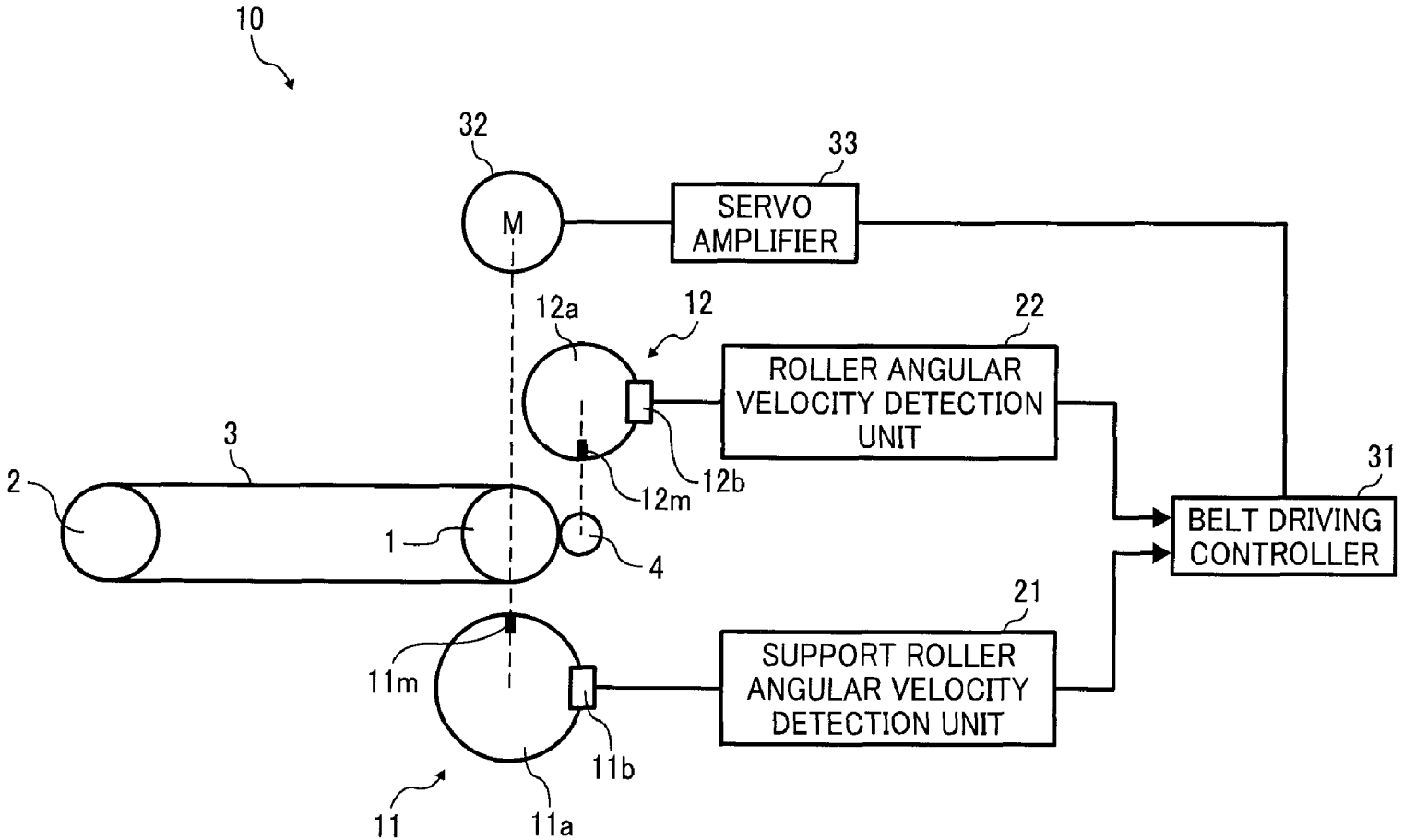
FIG. 1 schematically, illustrates an example of a belt unit according to an illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIGS. 1 and 2, a belt unit 10 according to an illustrative embodiment of the present invention is described.

Figure 2A:
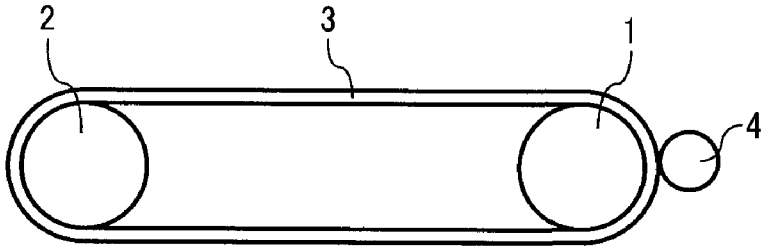
FIG. 2A illustrates an example of a belt driving mechanism of the belt unit shown FIG. 1.
Figure 2B:
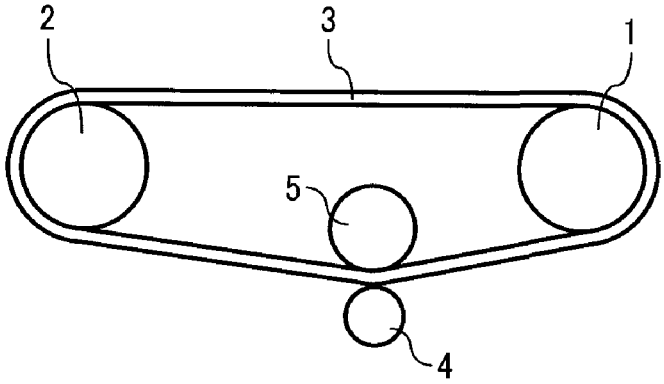
FIG. 2B illustrates another example of the belt driving mechanism of the belt unit shown FIG. 1.
Figure 2C:
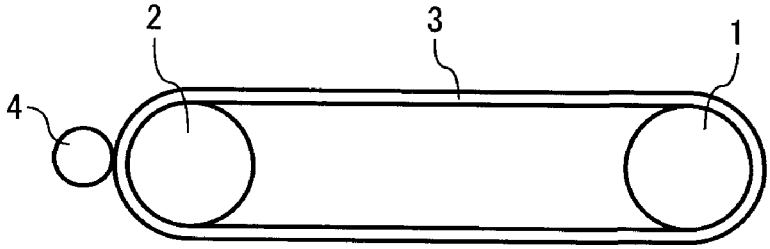
FIG. 2C illustrates another example of the belt driving mechanism of the belt unit shown FIG. 1.

FIG. 1 illustrates the belt unit 10, FIG. 2A illustrates a belt driving mechanism of the belt unit 10 shown FIG. 1, and FIGS. 2B and 2C illustrate different examples of the belt driving mechanism.

Referring to FIGS. 1 and 2A, the belt unit 10 includes a first roller 1 and a second roller 2 both serving as rotary support members, an endless belt 3 looped around the first roller 1 and the second roller 2, and a roller 4. The first roller 1 and the second roller 2 are also referred to as support rollers that support the belt 3. The first roller 1 is a driving roller that rotates the belt 3, and this rotation causes the second roller 2 serving as a driven roller to rotate. The roller 4 serves as a driven rotary member and faces the first roller 1 via the belt 3.

The belt unit 10 further includes rotary encoders 11 and 12 serving as detectors to detect rotational angular displacement or rotary angular velocity of the first roller 1 and the roller 4, respectively. The rotary encoders 11 and 12 are located on the opposite sides in a roller axial direction so as to prevent interference among the rotary encoders 11 and 12, the first roller 1, and the roller 4.

The belt unit 10 further includes a support roller angular velocity detection unit 21 connected to the rotary encoder 11, a roller angular velocity detection unit 22 connected to the rotary encoder 12, a belt driving controller 31, a driving motor 32, and a servo amplifier 33.

Other examples of the belt driving mechanism are described below with reference to FIGS. 2B and 2C.

In another example shown in FIG. 2B, the belt 3 is looped around the first roller 1 serving as the driving roller, the second roller 2 serving as the driven roller, and a roller 5 serving as another driven roller, and the roller 4 serving as the driven rotary member faces the roller 5 via the belt 3.

In another example shown in FIG. 2C, the belt 3 is looped around the first roller 1 serving as the driving roller and the second roller 2 serving as the driven roller, and the roller 4 serving as the driven rotary member faces the second roller 2 via the belt 3.

For example, the rotary encoders 11 and 12 have sufficiently large diameters, such as about four times as large as those of shafts of the first roller 1 and the roller 4, respectively, and 300 lines per inch are provided thereon for detecting the rotational angular displacement or rotary angular velocity.

However, it is to be noted that configurations of the rotary encoders 11 and 12 are not limited as long as rotational angular displacement or rotary angular velocity of the first roller 1 and the roller 4 can be detected.

In an example, the rotary encoders 11 and 12 are known optical encoders and respectively include transparent encoder wheels 11*a* and 12*a* made of glass, plastic, etc., and photosensors (encoder sensors) 11*b* and 12*b*. The encoder wheels 11*a* and 12*a* are attached to the first roller 1 and the roller 4 so that the axis of the encoder wheels 11*a* and 12*a* are identical to those of the first roller 1 and the roller 4, respectively. Further, the encoder wheels 11*a* and 12*a* are provided with timing marks formed at constant intervals along a concentric circle that are detected by the photosensors 11*b* and 12*b*, respectively. The encoder wheels 11*a* and 12*a* are further provided with position detection marks 11*m* and 12*m*, respectively.

Alternatively, each of the rotary encoders 11 and 12 can be a magnetic encoder including a magnetic disc on which timing marks are magnetically recorded along a concentric circle. This magnetic disc is attached to each of the first roller 1 and the roller 4 so that the axis of the disc is identical to that of the first roller 1 or the roller 4, and the timing marks are detected with a magnetic head.

Alternatively, a known tacho-generator can be used.

It is to be noted that, although the rotary encoders 11 and 12 in the present embodiment respectively detect rotational angular velocities ω1 and ω2 of the first roller 1 and the roller 4, similar results can be obtained by detecting their rotational displacements because rotational angular velocity is a time function of rotational angular displacement. Rotational angular displacement of the first roller 1 and the roller 4 can be obtained by counting pulses output by the rotary encoders 11 and 12, respectively.

Referring to FIG. 1, the belt driving controller 31 serves as a controller to control travel of the belt 3. More specifically, the belt driving controller 31 controls the driving motor 32 that drives the first roller 1 by controlling the servo amplifier 33 based on the rotational angular velocities ω1 and ω2 output from the support roller angular velocity detection unit 21 and the roller angular velocity detection unit 22.

It is to be noted that the configuration of the belt driving mechanism is not limited to the examples described above, and different configurations can be used as long as a rotary support member faces a driven rotary member via a belt. Further, it is to be noted that the location of the roller 4 is preferably outside a transport path through which an object is transported in order to avoid effects of the object, and other than that, the location of the roller 4 is not limited as long as the roller 4 is driven by the rotation of the belt 3.

The belt unit 10 described above can be used in an image forming apparatus, such as a printer, a facsimile machine, a copier, a multifunction machine including at least two of these functions, etc.

Driving control of the belt 3 according to the present embodiment is described below.

In the configuration described above, the rotational angular velocities ω1 and ω2 or rotational displacements x1 and x2 of one of the two support rollers supporting the belt 3, which in the present embodiment is the first roller 1, and the roller 4 facing that support roller are continuously detected. Then, the driving of the belt 3 is controlled so as to remove effects of a PLD fluctuation f(t) of the belt 3 using results of the detection.

The PLD fluctuation f(t) of the belt 3, an eccentric fluctuation g(t) of the first roller 1, and an eccentric fluctuation h(t) of the roller 4, which are factors to affect a travel velocity or travel distance of the belt 3, are described below.

The PLD fluctuation f(t) is a periodic function that indicates changes over time in the PLD of a portion of the belt 3 that passes a given position in a travel path thereof while the belt 3 makes one circuit. It is difficult to approximate the PLD fluctuation f(t) by decomposing the PLD fluctuation f(t) into AC components because there are less identifiable regularities within one cycle.

The eccentric fluctuation g(t) of the first roller 1 is a periodic function that indicates eccentric fluctuation over time of a portion of the first roller 1 that passes a given position in the travel path of the belt 3 while the first roller 1 makes one revolution. The eccentric fluctuation g(t) of the first roller 1 can be approximated to a sine wave whose one cycle corresponds to one revolution of the first roller 1.

The eccentric fluctuation h(t) of the roller 4 is a periodic function that indicates eccentric fluctuation over time of a portion of the roller 4 (driven roller) that passes a given position in the travel path of the belt 3 while the roller 4 makes one revolution. The eccentric fluctuation h(t) of the roller 4 can be approximated to a sine wave whose one cycle corresponds to one revolution of the roller 4.

The PLD fluctuation f(t) and the eccentric fluctuations g(t) and h(t) of the first roller 1 and the roller 4 significantly affect a travel velocity of the belt 3, which is hereinafter referred to as a belt travel velocity V, or a travel distance X of the belt 3. Therefore, the belt travel velocity V can be controlled more accurately by obtaining more accurate values of the PLD fluctuation f(t) and the eccentric fluctuations g(t) and h(t) of the first roller 1 and the roller 4 based on the rotational angular velocities ω1 and ω2 or rotational displacements x1 and x2.

First, removal of the PLD fluctuation f(t) when the first roller 1 and the roller 4 are produced sufficiently accurately so that the eccentric fluctuations g(t) and h(t) thereof can be disregarded is described below.

Figure 3:
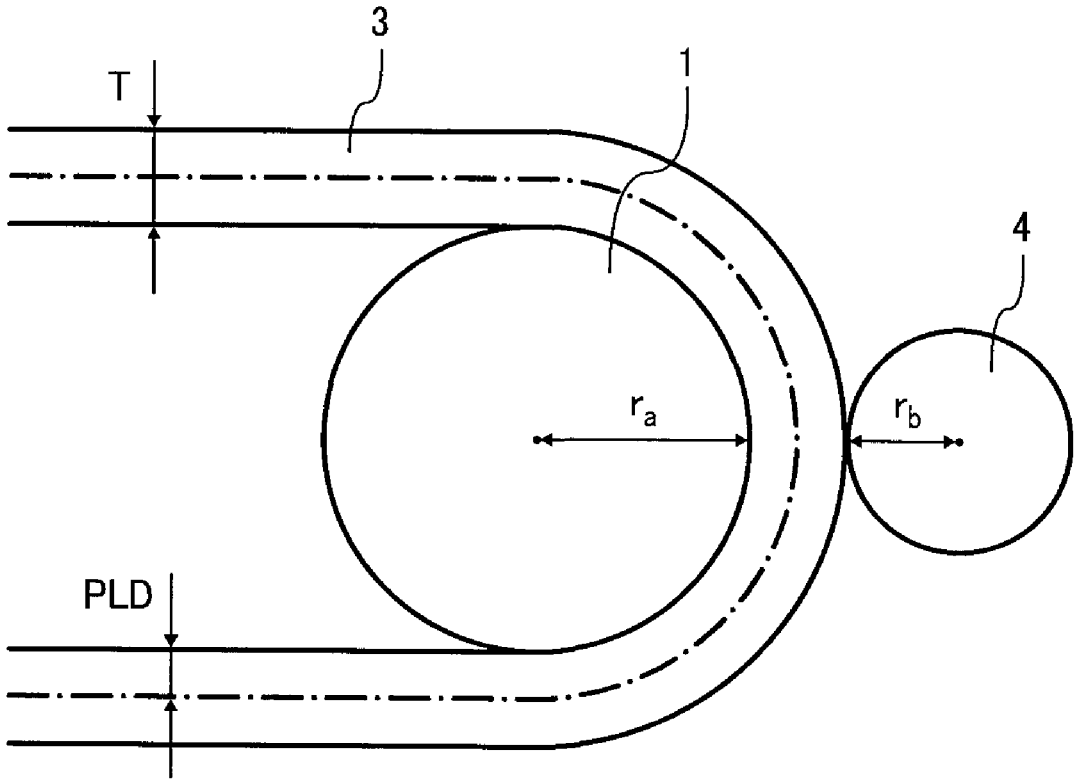
FIG. 3 is an enlarged illustration of a first roller and a roller facing the first roller via a belt included in belt driving mechanism shown in FIG. 2A.

FIG. 3 is an enlarged illustration of the first roller 1, the roller 4, and the belt 3.

Referring to FIG. 3, the PLD of the belt 3 correlates with a thickness and a layer structure of the belt 3 and can be approximated to the thickness of the belt 3, which is hereinafter referred to as the belt thickness T.

For example, the PLD is about half the belt thickness T in a single-layered belt (PLD=T/2). In this case, ½ is a constant that is determined based on the structure of the belt, which is hereinafter referred to as the PLD thickness constant $\alpha$. The PLD can be expressed as:

$$PLD=\alpha T \tag{3}$$

It is to be noted that, in a multilayered belt, the PLD thickness constant $\alpha$ can be ½ as well when materials of layers thereof have Young's moduli that are relatively close to each other and within such a range that effects thereof can be disregarded. By contrast, in the case of a multilayered belt including layers whose Young's moduli are different, the PLD is in a layer having a higher Young's modulus and the PLD can be set to a center of that layer. Alternatively, in the case of a belt including multiple layers whose Young's moduli are close to each other, the PLD can be obtained experimentally.

Further, because the PLD correlates closely with the belt thickness T, changes in the PLD thickness constant $\alpha$ caused by the PLD fluctuation are so small as that they can be disregarded. Consequently, the PLD fluctuation f(t) can be approximated by formula 4 shown below when j(t) represents the belt thickness fluctuation.

$$f(t)=\alpha j(t) \tag{4}$$

It is to be noted that the PLD thickness constant $\alpha$ and the belt thickness T are preliminarily set, preferably as adjustable constants. A set value of the belt thickness T is hereinafter referred to as a belt thickness set value $T_1$.

When the PLD fluctuation f(t) is converted to the belt thickness fluctuation j(t) using formula 4 shown above, a belt travel velocity detected by the first roller 1 can be expressed as:

$$V_1=V_r(r_a+\alpha T_1)/(r_a+\alpha j(t)) \tag{5}$$

where $V_1$ represent the belt travel velocity detected by the first roller 1, $r_a$ represents a radius of the first roller 1, $T_1$ represents the belt thickness set value, $\alpha$ represents the PLD thickness constant, $V_r$ represents a true value of the belt travel velocity, and j(t) represents the belt thickness fluctuation (time function).

Because the rotational angular velocity $\omega_1$ of the first roller 1 apparently changes due to the belt thickness fluctuation j(t), formula 5 shown above can express the belt travel velocity $V_1$ detected by the first roller 1, which is hereinafter also referred to as the detected belt travel velocity $V_1$.

Formula 5 is described below in further detail.

Relations between the rotational angular velocity $\omega_1$ of the first roller 1 and the belt travel velocity $V_1$ detected by the first roller 1 can be expressed as:

$$\omega_1=V_r/(r_a+\alpha j(t)) \tag{6}$$

The belt travel velocity $V_1$ detected by the first roller 1 can also be expressed by formula 7 shown below when $T_1$ represents the belt thickness set value.

$$V_1=(r_a+\alpha T_1)\omega_1 \tag{7}$$

Then, when formula 6 is applied to formula 7, formula 5 shown above can be obtained.

In other words, the belt travel velocity $V_1$ detected by the first roller 1 is lower than the true belt travel velocity $V_r$ when the belt thickness fluctuation j(t) is greater than the belt thickness set value $T_1$.

A belt travel velocity detected by the roller 4 is described below with reference to FIG. 3.

The belt travel velocity (surface travel velocity) detected by the roller 4 can be expressed as:

$$V_2=(r_a+j(t))\omega_1 \tag{8}$$

where $V_2$ represents the belt travel velocity detected by the roller 4.

When formula 6 shown above is applied to this formula 8, formula 9 shown below can be obtained.

$$V_2=V_r(r_a+j(t))/(r_a+\alpha j(t) \tag{9}$$

In other words, the belt travel velocity $V_2$ detected by the first roller 4, which is hereinafter also referred to as the detected belt travel velocity $V_2$ or surface travel velocity of the belt 3, increases as the belt thickness fluctuation j(t) increases.

Consequently, although amplitudes thereof are different, the belt travel velocities $V_1$ and $V_2$, respectively detected by the first roller 1 and the roller 4, fluctuate in the opposite phases with similar periods. Thus, effects of the belt thickness fluctuation j(t) can be removed by adding these waves having the opposite phases.

In the present embodiment, the belt thickness fluctuation j(t) affects both the support roller and the driven roller (roller 4) simultaneously because those rollers face each other via the belt as described above, and thus time of the respective belt thickness fluctuation j(t) can be regarded as identical. Therefore, the belt thickness fluctuation j(t) can be set as a constant and not as a function, and thus fluctuation in the travel velocity or travel distance of the belt caused by the belt thickness fluctuation j(t) can be removed more accurately.

More specifically, the following formula can be obtained by expanding formula 9 shown above with respect to the belt thickness fluctuation j(t).

$$j(t)=r_a(V_r-V_2)/(\alpha V_2-V_r) \tag{10}$$

When this formula 10 is substituted for the belt thickness fluctuation j(t) in formula 5 shown above, formula 11 shown below, which is a quadratic equation regarding the true belt travel velocity $V_r$, can be obtained, and further formula 12 shown below can be obtained by solving this quadratic equation.

$$(r_a+\alpha T_1)V_r^2+(\alpha r_a V_2+\alpha^2 V_2 T_1+r_a V_1-\alpha r_a V_1)V_r=0 \tag{11}$$

$$V_r=-(\alpha r_a V_2+\alpha^2 V_2 T_1+r_a V_1-\alpha r_a V_1)/(r_a+\alpha T_1) \tag{12}$$

Because the elements of formula 12 except the detected belt travel velocities $V_1$ and $V_2$ are constants, the true belt travel velocity $V_r$ can be obtained by respectively assigning actual values to the detected belt travel velocity $V_1$ and $V_2$. That is, the true belt travel velocity $V_r$ can be obtained regardless of the belt thickness fluctuation j(t).

It is to be noted that a table storing the true belt travel velocity $V_r$ in association with the detected belt travel velocities $V_1$ and $V_2$ can be prepared so that the true belt travel velocity $V_r$ can be obtained based on the detected belt travel velocities $V_1$ and $V_2$.

Further, because a positional displacement of the belt is an integral value of velocity over time, the positional displacement of the belt can be obtained regardless of the belt thickness fluctuation j(t) in the present embodiment.

A true travel distance $X_r$ of the belt 3 can be obtained using a table storing the true travel distance $X_r$ in association with the detected belt travel velocities $V_1$ and $V_2$, similarly to the true belt travel velocity $V_r$.

The relation between the surface travel velocity $V_2$ (belt travel velocity detected by the roller 4) and the rotational angular velocity $\omega_2$ of the roller 4 is described below with reference to FIG. 3.

The relation therebetween can be expressed as:

$$V_2=r_b\cdot\omega_2 \tag{13}$$

where $r_b$ represents a rotational radius of the roller 4.

According to formula 13 shown above, the surface travel velocity $V_2$ of the belt 3 can be obtained based on the rotational angular velocity $\omega_2$ of the roller 4.

As described above, the present embodiment includes the belt that is looped around two rotary support members and rotationally travels, the driven rotary member facing one of those rotary support members via the belt, rotated by travel of the belt, and the controller to control travel of the belt so as to minimize fluctuations in the travel velocity or travel distance of the belt based on the rotational angular displacements or the rotational angular velocities of the rotary support member and the rotary driven member. Because the two rotary members whose rotational angular displacements or rotational angular velocities are detected face each other via the belt, the belt thickness fluctuation j(t) affects both the rotary members simultaneously, and thus time of the respective belt thickness fluctuation j(t) can be regarded as identical. Therefore, the belt thickness fluctuation j(t) can be set as a constant and not as a function, and thus fluctuation in the travel velocity or travel distance of the belt caused by the belt thickness fluctuation j(t) can be removed more accurately.

Another illustrative embodiment of the present invention is described below with reference to FIG. 4.

Figure 4:
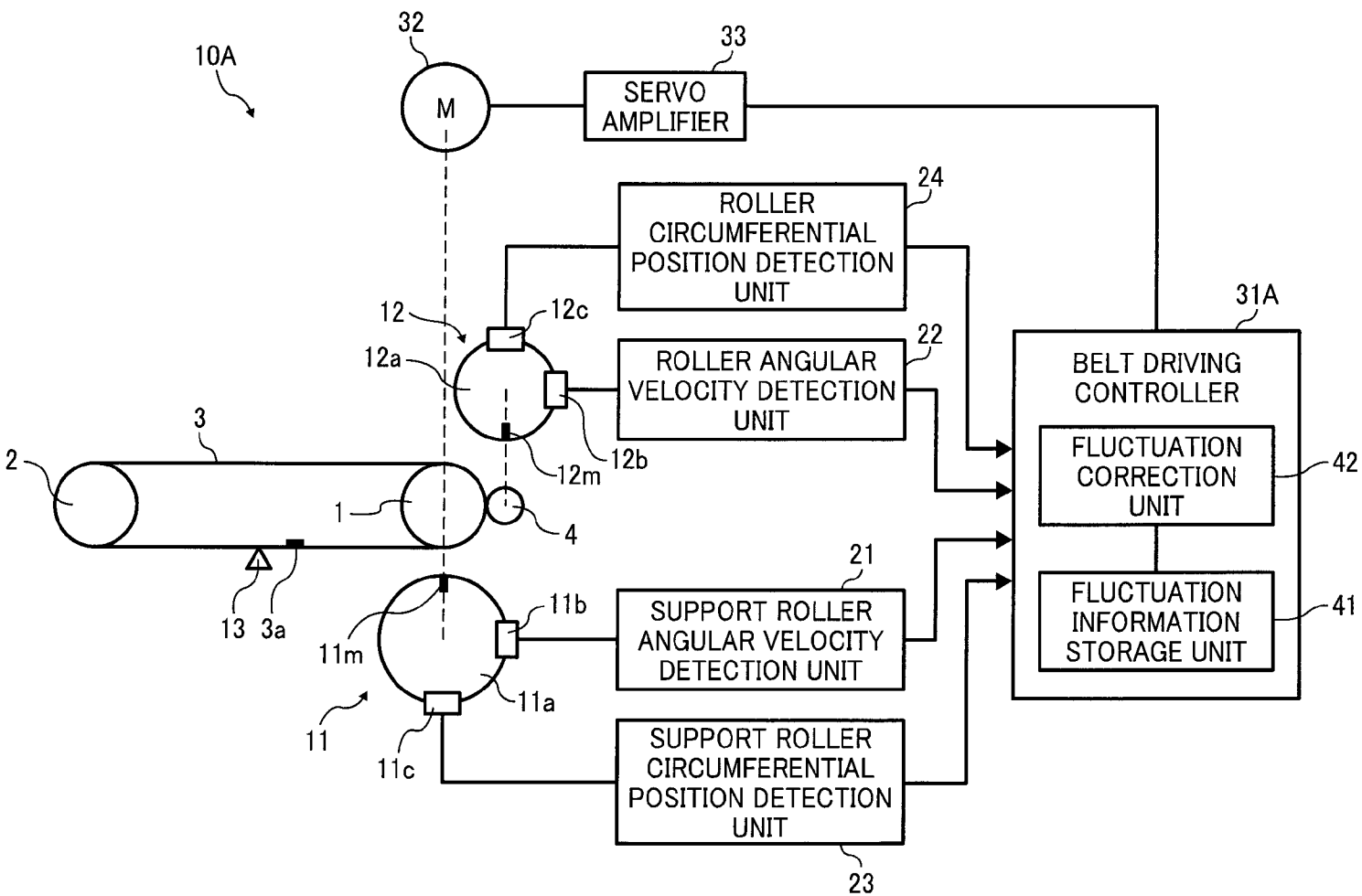
FIG. 4 schematically illustrates an example of a belt unit according to another illustrative embodiment of the present invention.

FIG. 4 illustrates a belt unit 10A according to another illustrative embodiment of the present invention.

As shown in FIG. 4, the belt unit 10A includes an endless belt 3 looped around a first roller 1 and a second roller 2, a roller 4 facing the first roller 1 via the belt 3, rotary encoders 11 and 12, a support roller angular velocity detection unit 21, a roller angular velocity detection unit 22, a driving motor 32, and a servo amplifier 33, similar to the belt unit 10 illustrated in FIG. 1.

The belt unit 10A further includes a support roller circumferential position detection unit 23 configured to detect a circumferential position of the first roller 1 according to pulses output from a photosensor 11*c* of the rotary encoder 11 and a roller circumferential position detection unit 24 configured to detect a circumferential position of the roller 4 according to pulses output from a photosensor 12*c* of the rotary encoder 12.

Further, a belt driving controller 31A of the belt unit 10A includes a fluctuation information storage unit 41 configured to store information about fluctuation in rotation in a time period required for the belt 3 to make a single circuit, and a fluctuation correction unit 42. The belt unit 10A further includes a belt circumferential position detection unit 13 configured to detect a positional mark 3*a* provided on the belt 3.

In the present embodiment, the eccentric fluctuation g(t) of the first roller 1 and the eccentric fluctuation h(t) of the roller 4 are evaluated as well as the belt thickness fluctuation j(t).

Figure 5:
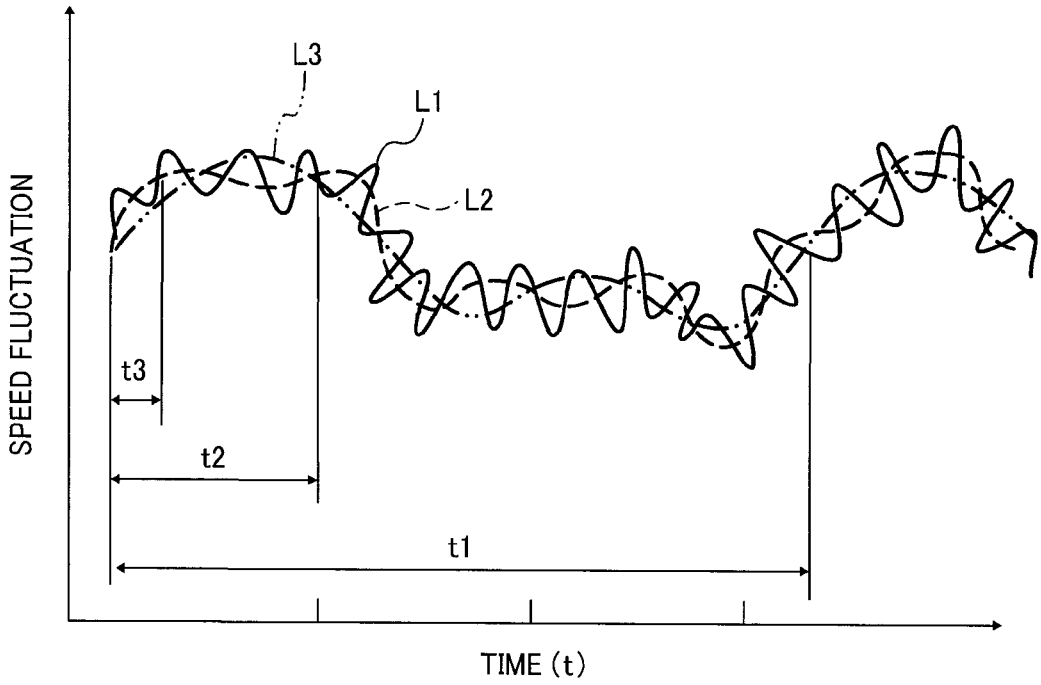
FIG. 5 illustrates fluctuation in a belt travel velocity detected by a roller facing a first roller when rotational angular velocity of the first roller is kept constant.

FIG. 5 is a graph of the belt travel velocity $V_2$ detected by the roller 4 when the rotational angular velocity of the first roller 1 is kept constant, which serves as rotational fluctuation information, and a horizontal axis and a vertical axis indicate time and velocity, respectively.

In FIG. 5, reference characters tl, t2, and t3 respectively indicate periods of the fluctuation due to the thickness of the belt 3 and eccentric fluctuations of the first roller 1 and the roller 4, a solid line Ll indicates the detected belt travel velocity $V_2$ (output value), a dashed line L2 indicates velocity fluctuation caused by the eccentric fluctuation g(t) of the first roller 1, and a chain double-dashed line L3 indicates velocity fluctuation caused by the belt thickness fluctuation j(t).

As shown in FIG. 5, because the fluctuation periods t1, t2, and t3 of the belt 3, the first roller 1, and the roller 4, respectively, are different, the eccentric fluctuation g(t) of the first roller 1 and the eccentric fluctuation h(t) of the roller 4 can be easily obtained.

Because fluctuation in the rotational velocity of each of the first roller 1 and the roller 4 is mainly caused by eccentricity, AC components each having a specific frequency are extracted from the data shown in FIG. 5 through Fourier transformation and then stored in the fluctuation information storage unit 41.

Further, a fluctuation component due to the belt thickness fluctuation j(t) is obtained by removing the fluctuation components due to the first roller 1 and the roller 4 each having a specific frequency from the detected belt travel velocity $V_2$ and then stored in the fluctuation information storage unit 41. Alternatively, the PLD fluctuation f(t) may be obtained from the belt thickness fluctuation j(t) using formula 4 shown above and then stored in the fluctuation information storage unit 41.

It is to be noted that, because the fluctuation component due to the belt thickness fluctuation f(t) has little AC periodic regularity, removal of the fluctuation components due to the first roller 1 and the roller 4 from total fluctuation is preferable to removal of the velocity fluctuation component due to the belt thickness fluctuation f(t) therefrom.

Further, the belt thickness fluctuation j(t) affects both the first roller 1 and the roller 4 simultaneously because those rollers face each other via the belt 3 as described above, and thus the belt thickness fluctuation j(t) that affects the respective rollers can be set as a constant and not as a function.

Figure 6:
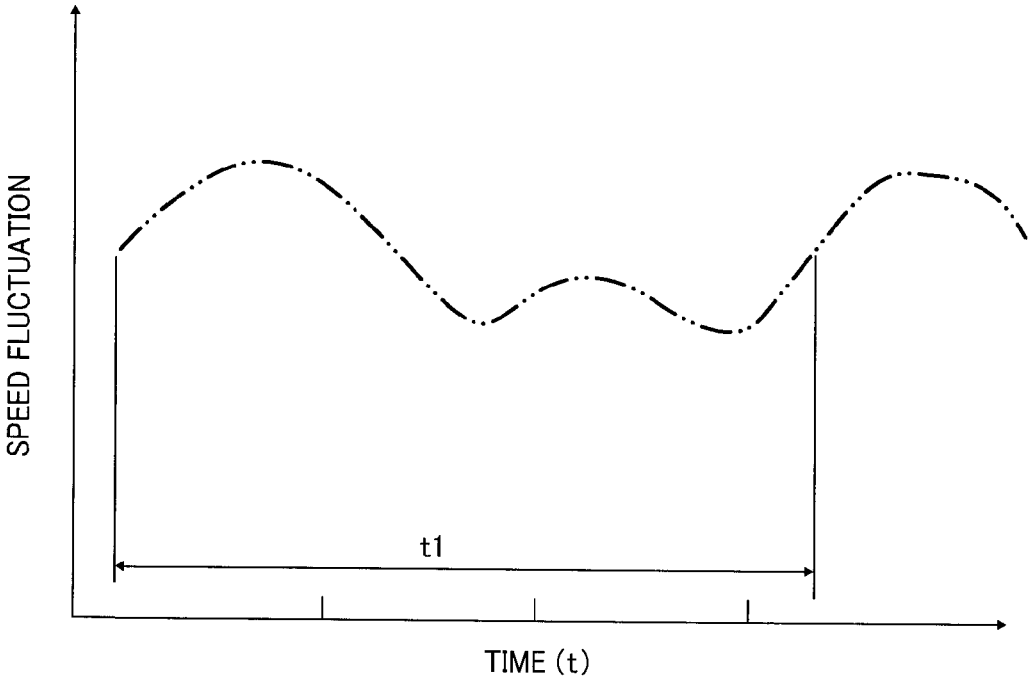
FIG. 6 illustrates a fluctuation component due to fluctuation in a belt thickness extracted from the fluctuation in the belt travel velocity shown in FIG. 5.
Figure 7:
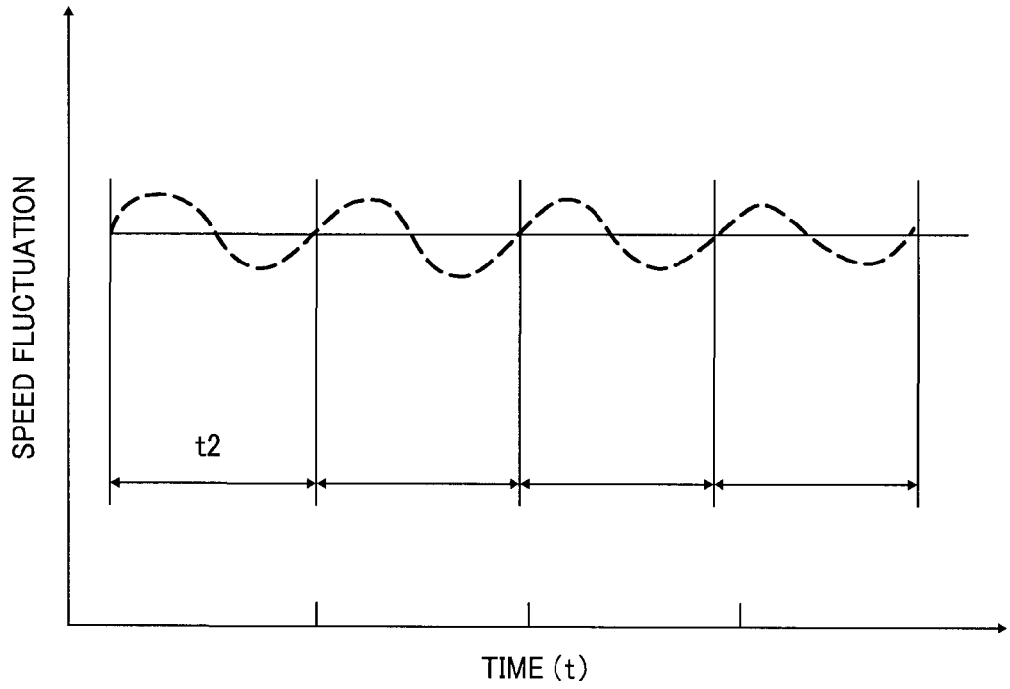
FIG. 7 illustrates a fluctuation component due to eccentric fluctuation of the first roller extracted from the fluctuation in the belt travel velocity shown in FIG. 5.
Figure 8:
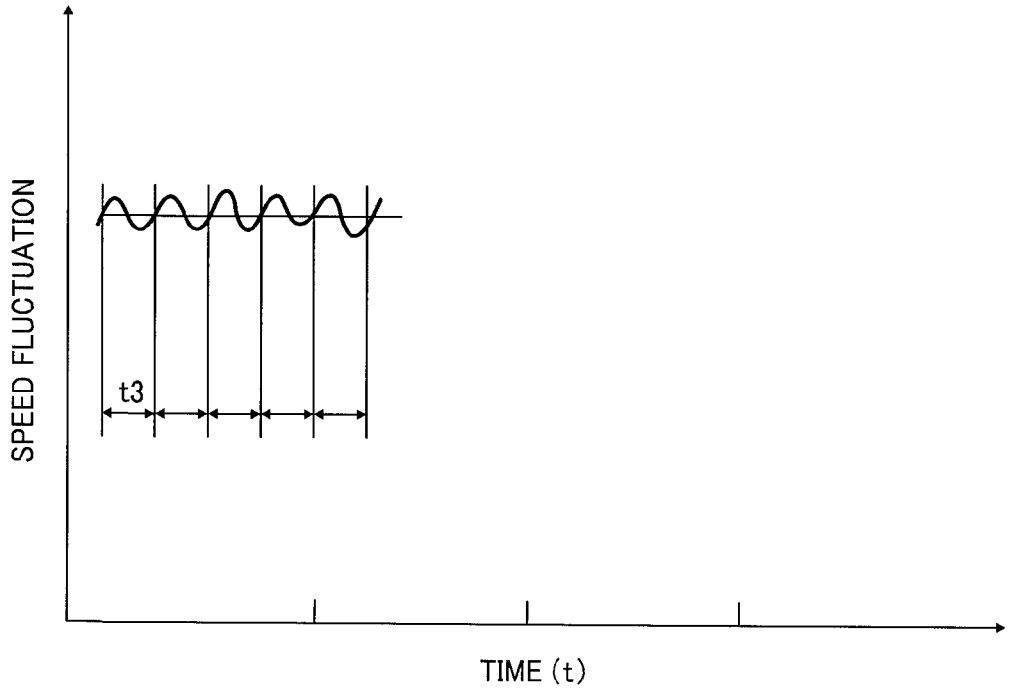
FIG. 8 illustrates a fluctuation component due to eccentric fluctuation of the roller facing the first roller extracted from the fluctuation in the belt travel velocity shown in FIG. 5.

Thus, the fluctuation shown in FIG. 5 can be disassembled into three fluctuation components of a fluctuation component due to belt thickness fluctuation j(t) shown in FIG. 6, a fluctuation component due to the eccentric fluctuation g(t) of the first roller 1 shown in FIG. 7, and a fluctuation component due to the eccentric fluctuation h(t) of the roller 4 shown in FIG. 8.

Then, these fluctuation components are stored in the fluctuation information storage unit 41. It is to be noted that the fluctuation components can be stored in any form as long as they are information about the fluctuations in the travel velocity or travel distance.

Then, according to the information regarding the fluctuation components stored in the fluctuation information storage unit 41, the belt driving controller 31A controls the driving motor 32 so as to minimize fluctuation in the travel velocity or travel distance of the belt 3 using the fluctuation correction unit 42.

That is, travel of the belt 3 can be controlled based on corrected information about one of the rotational angular displacement and the rotational angular velocity of at least one of the first roller 1 and the roller 4.

It is to be noted that, in a configuration in which those two rollers are located at different positions in the circumferential direction of the belt and the belt travel velocity is detected at two different positions, it is difficult to evaluate the belt thickness fluctuation j(t) correctly as in the present embodiment because the belt thickness fluctuation j(t) will affect those rollers separately and therefore differently.

As described above, in the present embodiment, the belt thickness fluctuation is evaluated by removing the fluctuation components due to the first roller 1 and the roller 4 from total fluctuation because the periods and the wave (sine wave) thereof can be evaluated relatively correctly.

Therefore, it is not necessary to predict fluctuation period of the belt thickness, and the present embodiment can accommodate the belt thickness fluctuation j(t), which occurs accidentally in the production process.

It is to be noted that, although the example described above with reference to FIG. 5 uses the belt travel velocity $V_2$ detected by the roller 4 when the rotational angular velocity of the first roller 1 is kept constant, alternatively, the rotational fluctuation information can be the belt travel velocity $V_1$ detected by the first roller 1 when the rotational angular velocity of the roller 4 is kept constant.

Alternatively, the fluctuation components can be disassembled more accurately by evaluating both the belt travel velocities $V_1$ and $V_2$ respectively detected by the first roller 1 and roller 4 when the rotational angular velocity of the other roller is kept constant, and by comparing the detected belt travel velocities $V_1$ and $V_2$ with each other.

Further, although the description above concerns the method in which the rotational angular velocity of either the first roller 1 or the roller 4 is kept constant, alternatively, when maintaining a constant velocity is difficult, the detected belt travel velocities may be evaluated as follows: The fluctuation in the rotational angular velocity of the driving roller is stored, and then the velocity fluctuation data detected by the driving roller is deducted from that detected by the other roller. Then, the processes described above are performed by evaluating the detected belt travel velocity $V_1$ or $V_2$ when the rotational angular velocity of the roller 4 or the first roller 1 is kept constant.

Further, by providing the support roller circumferential position detection unit 23 and the roller circumferential position detection unit 24 to respectively locate the relative positions of the first roller 1 and the roller 4 with respect to the circumferential position of the belt 3, the driving of the belt 3 can be controlled, based on the fluctuation components stored in association with the positional information so as to minimize fluctuation in the belt travel velocity.

For example, driving of the belt 3 can be controlled more reliably by removing the fluctuation components stored in the fluctuation information storage unit 41 from the detected travel velocity or travel distance.

Further, the fluctuation components to be stored and/or the circumferential position detection unit to detect the relative position in the circumferential direction can be selected as desired, and thus is not limited to the examples described above. Alternatively, for example, the driving of the belt 3 may be controlled based on the rotational angular velocity of only the first roller 1 so as to minimize fluctuation in the belt travel velocity or distance by storing only the fluctuation components due to the first roller 1 and the belt 3 and providing the circumferential position detection unit.

Alternatively, the driving of the belt 3 may be controlled so as to minimize fluctuation in the belt travel velocity or distance by storing only the fluctuation components due to the first roller 1 and the roller 4, providing the circumferential position detection unit, and then removing the fluctuation component due to the belt 3 through the method described with reference to FIG. 1.

Descriptions will be given below of a timing with which the fluctuation components of the travel velocity or travel distance of the belt 3 are evaluated, referring to FIGS. 4 and 9.

Figure 9:
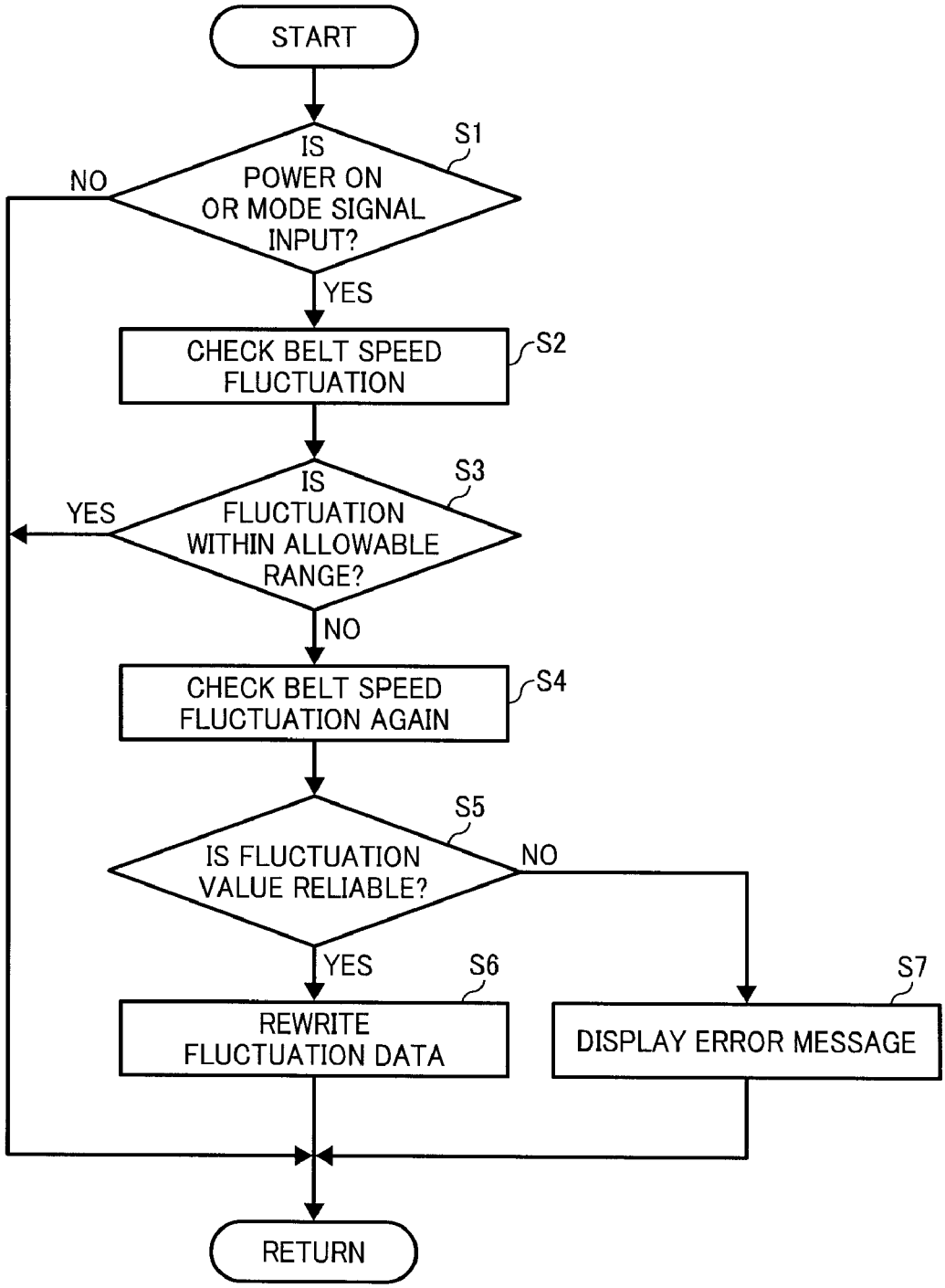
FIG. 9 illustrates a flow of belt velocity adjustment.

FIG. 9 illustrates steps in a process of belt velocity adjustment.

It is to be noted that, in the present embodiment, the fluctuation components of the travel velocity or travel distance of the belt 3 are evaluated in an initialization process performed when an apparatus including the belt unit is turned on, and thus measurement can be performed under conditions of a constant driving load and reliable rotational frequencies of the rollers because the belt unit 10A transports no object.

Referring to FIGS. 4 and 9, when the power is turned on at S1, at S2 the belt driving controller 31A performs a first evaluation and checks fluctuation in the travel velocity of the belt 3 and then at S3 determines whether or not a fluctuation value is within an allowable range, that is, under a given allowable value. When the fluctuation value exceeds the allowable value (NO at S3), at S4 the belt driving controller 31A performs a second evaluation and again checks fluctuation in the travel velocity of the belt 3.

Then, at S5 the belt driving controller 31A determines whether or not the fluctuation value is reliable. When the fluctuation value is determined to be reliable (YES at S5), at S6 the belt driving controller 31A rewrites the fluctuation information stored in the fluctuation information storage unit 41. By contrast, when fluctuation value is determined to be unreliable (NO at S5), at S7 an error message is displayed on a display of the apparatus.

Alternatively, the processes described above can be performed according to a mode signal, which can be input when a user or maintenance person recognizes failure, such as image failure in the case of the image forming apparatus, and instructs the apparatus to perform a mode to evaluate the fluctuation components using an operating unit of the apparatus or through a driver of a host (information processing apparatus).

In the processes described above, the given allowable value or range of the fluctuation value under or within which the operation of the apparatus is not affected (e.g. image failure does not occur) is set, and at S4 the fluctuation components are again evaluated and confirmed when the fluctuation value exceeds the allowable value. Then, the data of the fluctuation components is updated only when the fluctuation value evaluated at S4 still exceeds the allowable value, not each time the belt driving controller 31A checks fluctuation in the travel velocity of the belt 3. This enables time required for the belt velocity adjustment and error in the detection to be reduced.

Further, the belt driving controller 31A may evaluate the information obtained repeatedly as follows: For example, data of the fluctuation in the belt travel velocity is recorded for two periods of the belt 3, the fluctuation components of a first period and a second period are respectively extracted, and then the extracted fluctuation component of the first period and the second period are compared regarding each of the first roller 1, the roller 4, and the belt 3. When each of the fluctuation components of the first period and the second period is under the given allowable value, the belt driving controller 31A determines that the detection result is correct and then update the data. Thus, error in the detection can be better prevented.

It is to be noted that, in the example described above, an error message may be displayed on the operation unit of the apparatus or the host when the fluctuation components of the first period and the second period are different.

Descriptions will be given below of an example of the image forming apparatus to which the present invention is applied with reference to FIGS. 10 and 11.

Figure 10:
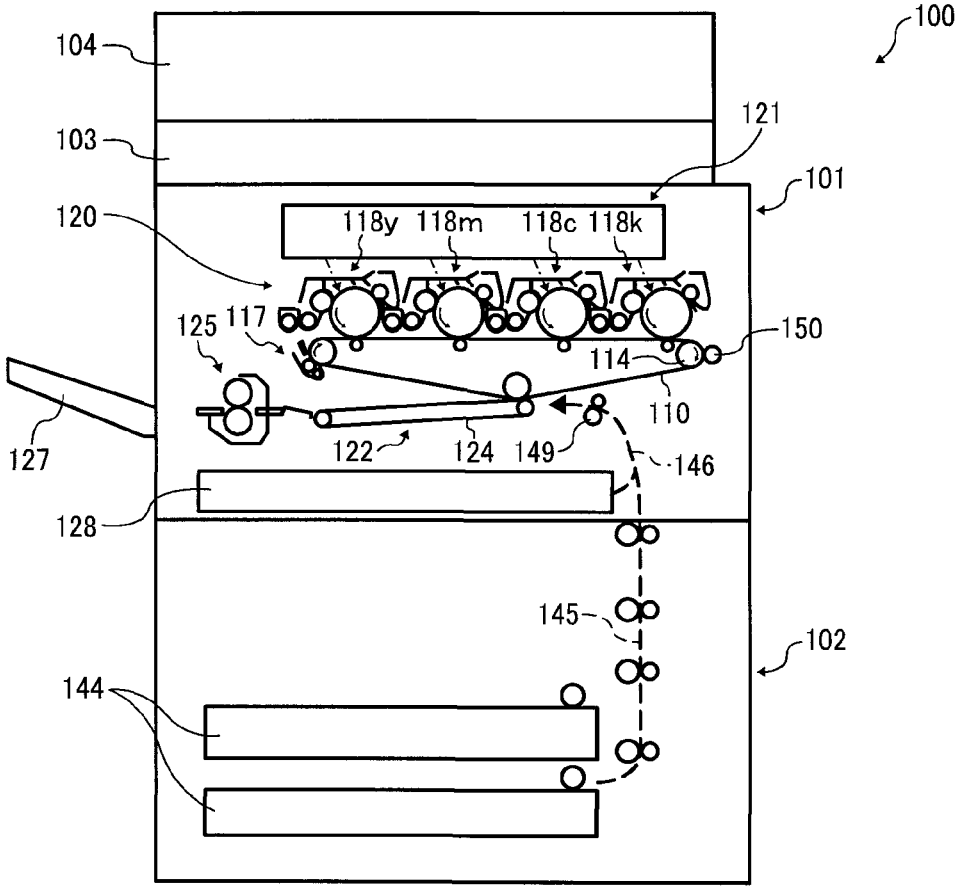
FIG. 10 schematically illustrates an example of an image forming apparatus according to an illustrative embodiment of the present invention.
Figure 11:
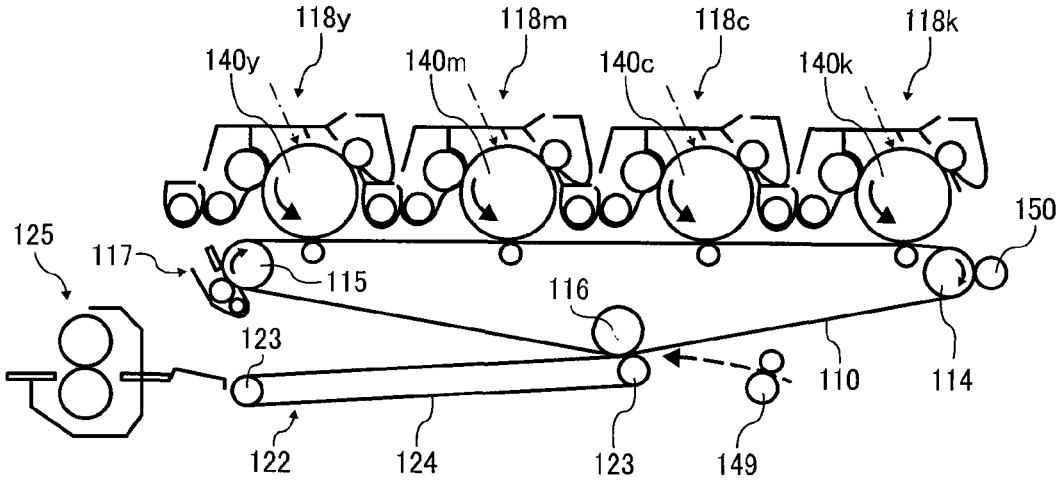
FIG. 11 illustrates a configuration around a tandem image forming unit included in the image forming apparatus shown in FIG. 10.

FIG. 10 illustrates a configuration of an image forming apparatus 100 schematically, and FIG. 11 illustrates a configuration around a tandem image forming unit included therein.

Referring to FIG. 10, the image forming apparatus 100 is a tandem electronographic image forming apparatus and employs an intermediate transfer (indirect transfer) method. The image forming apparatus 100 includes a main body 101, a sheet feed table 102 on which the main body 101 is located, a scanner 103 located above the main body 101, and an automatic document feeder (ADF) 104 located above the scanner 103.

As shown in FIGS. 10 and 11, an intermediate transfer belt 110, serving as an intermediate transfer member that also serves as an image carrier, is provided in a center portion of the main body 101. The intermediate transfer belt 110 is looped around support rollers 114, 115, and 116, serving as rotary support members, and rotationally moves clockwise in FIGS. 10 and 11. In the present embodiment, the support roller 116 is a driving roller, and a roller 150 serving as a driven rotary member faces the support roller 114 via the intermediate transfer belt 110.

The main body 101 further includes a belt cleaner 117 provided on the left of the support roller 115 in FIG. 11 and a tandem image forming unit 120 facing a portion of the intermediate transfer belt 110 stretched between the support rollers 114 and 115. The belt cleaner 117 removes toner remaining on the intermediate transfer belt 110 after an image is transferred therefrom.

In the tandem image forming unit 120, image forming units 118*y*, 118*m*, 118*c*, and 118*k* for forming yellow, magenta, cyan, and black images, respectively, are arranged in a direction in which the intermediate transfer belt 110 moves. The image forming units 118*y*, 118*m*, 118*c*, and 118*k* include photoreceptor 140*y*, 104*m*, 140*c*, and 140*k*, respectively.

It is to be noted that reference characters y, m, c, and k represent yellow, magenta, cyan, and black, respectively, and may be omitted when color discrimination is not required.

The main body 101 further includes an exposure unit 121 serving as a latent image forming unit, located above the tandem image forming unit 120, a secondary transfer unit 122, a fixer 125 located on the left of the secondary transfer unit 122, a discharge tray 127 located on the left of the secondary transfer unit 122 in FIG. 10, and a sheet reverse unit 128.

The secondary transfer unit 122 is located opposite the tandem image forming unit 120 with respect to the intermediate transfer belt 110 and includes two rollers 123 and a secondary transfer belt 124, serving as a recording medium transporter, looped around the rollers 123.

The secondary transfer belt 124 presses against the support roller 116 via the belt 110. The secondary transfer unit 122 transfers an image formed on the intermediate transfer belt 110 onto a sheet that is a recording medium. After the image transferred onto the sheet is fixed by the fixer 125, the sheet is discharged onto the discharge tray 127.

The sheet reverse unit 128 is located beneath the secondary transfer unit 122 and the fixer 125 in parallel to the tandem image forming unit 120 and reverses the sheet in order to form images on both sides thereof.

The sheet feed table 102 includes sheet cassettes 144 from which the sheet is fed through a transport path 145 and a feed path 146 of the main body 101 and stopped by a pair of registration rollers 149.

Copying operation using the image forming apparatus 100 is described below.

An original document is set in the ADF 104 or a contact glass of the scanner 103, and then scanner 103 is driven to read image information of the original document. While the image information of the original document is thus read, a driving motor, not shown, rotates the support roller 116, which rotates the intermediate transfer belt 110 clockwise in FIGS. 10 and 11. Further, rotation of the intermediate transfer belt 110 rotates the support rollers 114 and 115 serving as driven rollers.

Further, in parallel to the operation described above, the photoreceptors 140 in the image forming units 118 are rotated, and the exposure unit 121 directs lights such as laser beam onto the photoreceptors 140*y*, 140*c*, 140*m*, and 140*k* according to yellow, cyan, magenta, and black image information, forming yellow, cyan, magenta, and black latent images thereon, respectively. Further, the yellow, cyan, magenta, and black latent images on the photoreceptors 140 are respectively developed with yellow, cyan, magenta black toners into single color toner images.

Subsequently, the toner images are sequentially transferred from the photoreceptors 140 and superimposed one on another onto the intermediate transfer belt 110 in a primary transfer process, forming a multicolor image thereon.

While the multicolor image is thus formed, the sheet is fed from one of the sheet cassettes 144 and transported along the transport path 145 and the feed path 146 to the pair of registration rollers 149.

Then, in synchronization with the multicolor image on the intermediate transfer belt 110, the registration rollers 149 rotate and forward the sheet to a nip formed between the secondary transfer unit 122 and the intermediate transfer belt 110, which is also referred to as a secondary transfer position. In the nip, the secondary transfer unit 122 transfers the multicolor image from the intermediate transfer belt 110 onto the sheet in a secondary transfer process.

The multicolor image on the sheet is fixed thereon by the fixer 125 and then discharged onto the discharge tray 127. Alternatively, after the image is fixed on the sheet, the sheet reverse unit 128 may reverse and send back the sheet to the secondary transfer position so that images are formed on both sides of the sheet, and then the sheet is discharged onto the discharge tray 127.

After the image is transferred from the intermediate transfer belt 110, the belt cleaner 117 removes toner remaining thereon in preparation for subsequent image formation by the tandem image forming unit 120.

An example of a configuration of the intermediate transfer belt 110 used in the present embodiment is described below.

It is to be noted that the description below is not limited to the intermediate transfer belt but is also applicable to various types of belts whose driving is controlled.

The intermediate transfer belt 110 can be a single layered belt including a fluorine resin, a polycarbonate resin, a polyimide resin, or etc., as a main material or an elastic multilayered belt, in which multiple layers are formed in a thickness direction, that includes an elastic member. The elastic member can be used in all layers or a part of the elastic multilayered belt.

Typically, the belts used in the image forming apparatus including the intermediate transfer belt should fulfill multiple functions, and thus multilayered belts having various characteristics are wisely used in order to fulfill the required functions.

For example, the intermediate transfer belt 110 requires relatively high levels of toner releasability, ability to form a nip with the photoreceptors, durability, tensile strength, and frictional force with the driving roller and a relatively low level of frictional force with the photoreceptors.

Toner releasability is required to transfer the toner image from the intermediate transfer belt onto the recording medium and to remove the toner remaining on the intermediate transfer belt 10 after the secondary transfer process. With the ability to form a nip with the photoreceptors, the intermediate transfer belt 110 can adhere to the photoreceptors 140, and thus the image on the photoreceptor is transferred onto the intermediate transfer belt 110.

Durability is required so that the intermediate transfer belt 10 can be used for a longer time period with less cracks and abrasions, and thus the running cost is reduced. Tensile strength is required to prevented or reduce stretch and shrinkage in a circumferential direction of the intermediate transfer belt 110 while the intermediate transfer belt 110 is rotated so that the travel velocity and the travel position thereof can be accurately controlled.

The intermediate transfer belt 110 requires a relatively high frictional force with the driving roller so that slippage between the driving roller (support roller 116) and the intermediate transfer belt 110 is prevented or reduced, and thus the driving of the intermediate transfer belt 110 can be controlled reliably and accurately.

The intermediate transfer belt 110 requires a relatively low frictional force with the photoreceptors 140 so as to minimize fluctuation in load with effects of slippage therebetween even when the rotational velocity of the photoreceptors 140 and the travel velocity of the intermediate transfer belt 110 are different.

In order to have all characteristics described above, the multilayered belt described below can be used as the intermediate transfer belt 110.

An example of a layer structure of the intermediate transfer belt, 110 is described below with reference to FIG. 12.

Figure 12:
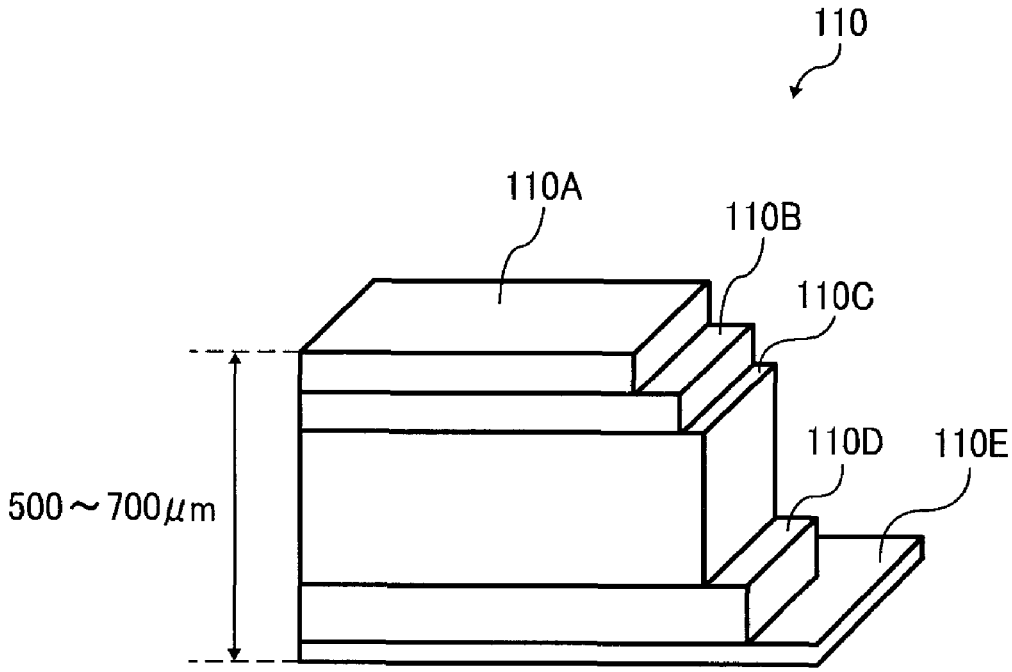
FIG. 12 is a perspective view illustration an example of an intermediate transfer belt included in the image forming apparatus shown in FIG. 10.

In the example shown in FIG. 12, the intermediate transfer belt 110 is an endless belt including five layers whose main materials are different, and a thickness of the intermediate transfer belt 110 is within a range of 500 μm to 700 μm. As shown in FIG. 12, the intermediate transfer belt 110 includes a first layer 110A, a second layer 110B, a third layer 110C, a fourth layer 110D, and a fifth layer 110E from a outer surface that contacts the photoreceptors 140.

The first layer 110A is a coat layer including polyurethane resin filled with fluorine. With the first layer 110A, the frictional force between the intermediate transfer belt 110 and the photoreceptors 140 can be relatively low and toner releasability can be relatively high. The second layer 110B is a coat layer including silicone-acrylic copolymer and contributes to enhance durability of the first layer 110A and reduce degradation over time of the third layer 110C.

The third layer 110C is a rubber layer (elastic layer) including chloroprene and has a thickness of within a range of 400 μm to 500 μm and a Young's module of within a range of 1 Mpa to 20 Mpa. Because the third layer 110C can deform at the secondary transfer position according to partial unevenness caused by the toner image or uneven surface of the sheet, a transfer pressure to the toner image is not excessively high, thus preventing partial absence of the toner on the image transferred onto the sheet. Further, with the third layer 110C, the intermediate transfer belt 110 can fully adhere to the recording medium even if its surface is not smooth, and thus the image transferred onto the sheet can be uniform.

The fourth layer 110D includes polyvinylidene fluoride and has a thickness of about 100 μm and a Young's module of within a range of 500 Mpa to 1000 Mpa. The fourth layer 110D prevents or reduce stretch and shrinkage of the intermediate transfer belt 110 in the circumferential direction.

The fifth layer 110E is a coat layer including polyurethane and has a relatively high frictional coefficient with the driving roller (support roller 116).

Other examples of the materials that can be used in the intermediate transfer belt 110 are as follows:

The first layer 110A and the second layer 110B should prevent or reduce contamination of the photoreceptors 140 due to the elastic material, reduce frictional resistance of the surface of the intermediate transfer belt 10, and enhance transferability of toner onto the recording medium. By reducing the surface frictional resistance, toner adhesion is reduced, and thus the intermediate transfer belt 10 can be better cleaned.

To achieve the functions described above, as a material of the first layer 110A and the second layer 110B, for example, one or a combination of a polyurethane resin, a polyester resin, and an epoxy resin can be used. Further, in order to enhance lubricity by reducing surface energy, powder or particles of one or a combination of a fluorocarbon resin, a fluorine compound, fluorocarbon, a titanium dioxide, silicon carbide can be dispersed in the first layer 110A and/or the second layer 110B. Alternatively, particles of one of these having different particle sizes can be dispersed therein. Alternatively, the first layer 110A and/or the second layer 110B may be a layer whose surface energy is reduce by forming a fluorine-rich layer on its surface through heat processing, such as a fluorinated rubber.

Examples of a material of the elastic third layer 110C include a butyl rubber, a fluorinated rubber, an acrylic rubber, EPDM (ethylene propylene diene monomer), NBR (acrylonitrile butadiene rubber), an acrylonitrile-butadiene-styrene natural rubber, an isoprene rubber, a styrene-butadiene rubber, a butadiene rubber, an ethylene-propylene rubber, an ethylene-propylene polymer, a chloroprene rubber, chlorosulfonated polyethylene, chlorinated polyethylene, a urethane rubber, syndiotactic 1,2-polybutadiene, an epichlorohydrin rubber, a silicone rubber, a fluorine rubber, a polysulfide rubber, a polynorbornene rubber, a hydrogenated nitrile rubber, and a thermoplastic elastomer. Examples of the thermoplastic elastomer include a polystyrene elastomer, a polyolefin elastomer, a polyvinylchloride elastomer, a polyurethane elastomer, a polyamide elastomer, a polyurea elastomer, a polyester elastomer, and a fluorocarbon resin elastomer. These can be used alone or in combination.

Examples of a material of the fourth layer 110D include polycarbonate; fluorocarbon resins such as ETFE (ethylene-tetrafluoroethylene) and PVDF (polyvinylidenefluoride); styrene resins (polymers or copolymers including styrene or a styrene substituent) such as polystyrene, chloropolystyrene, poly-α-methylstyrene, a styrene-butadiene copolymer, a styrene-vinylchloride copolymer, a styrene-vinylacetate copolymer, a styrene-maleate copolymer, a styrene-esteracrylate copolymer (a styrene-methylacrylate copolymer, a styrene-ethylacrylate copolymer, a styrene-butylacrylate copolymer, a styrene-octylacrylate copolymer and a styrene-phenylacrylate copolymer), a styrene-estermethacrylate copolymer (a styrene-methylmethacrylate copolymer, a styrene-ethylmethacrylate copolymer and a styrene-phenylmethacrylate copolymer), a styrene-α-methylchloroacrylate copolymer and a styrene-acrylonitrile-esteracrylate copolymer; a methylmethacrylate resin; a butyl methacrylate resin; an ethyl acrylate resin; a butyl acrylate resin; a modified acrylic resin such as a silicone-modified acrylic resin, a vinylchloride resin-modified acrylic resin and an acrylic urethane resin; a vinylchloride resin; a styrene-vinylacetate copolymer; a vinylchloride-vinyl-acetate copolymer; a rosin-modified maleic acid resin; a phenol resin; an epoxy resin; a polyester resin; a polyester polyurethane resin; polyethylene; polypropylene; polybutadiene; polyvinylidenechloride; an ionomer resin; a polyurethane resin; a silicone resin; a ketone resin; an ethylene-ethylacrylate copolymer; a xylene resin; a polyvinylbutyral resin; a polyamide resin; a modified-polyphenyleneoxide resin, etc. These can be used alone or in combination.

Examples of a method of preventing elongation of the elastic belt include a method in which a rubber layer is formed on a resin interlining layer that less extends and a method in which an elongation inhibitor is included in an interlining layer, and are not limited thereto.

Examples of a material of the interlining layer include, but are not limited to, a natural fiber such as cotton and silk; a synthetic fiber such as a polyester fiber, a nylon fiber, an acrylic fiber, a polyolefin fiber, a polyvinylalcohol fiber, a polyvinylchloride fiber, a polyvinylidenechloride fiber, a polyurethane fiber, a polyacetal fiber, a polyfluoroethylene fiber and a phenol fiber; an inorganic fiber such as a carbon fiber, a glass fiber and a boron fiber; and a metallic fiber such as an iron fiber and a copper fiber. These can be used alone or in combination in form of a fabric or a filament.

The interlining layer can be prepared using fabric or thread including one or more of the above materials. Twisting method of thread is not limited, and thread produced by twisting one or more filaments, a piece twist yarn, a ply yarn, and two play yarn can be used.

Further, filaments of the above-described materials can be blended. Needless to say, the filament can be subject to an electroconduction treatment. Regarding fabric, any fabrics such as a knitted fabric and a mixed weave fabric can be used, and can be subject to an electroconductive treatment. The method of forming an interlining layer, includes, and not limited to, a method in which cylindrically-woven fabric is provided over a metallic mold and a coated layer is formed thereon, a method in which cylindrically-woven fabric is dipped in a liquid rubber and a coated layer is formed on one side or both sides thereof, and a method in which thread is spirally wound around a metallic mold and a coated layer is formed thereon.

Further, depending on the type of the layer, a conductive material to control electrical resistivity can be used. Examples of such a conductive material include, but are not limited to, a metallic powder such as carbon black, graphite, aluminum and nickel; and an electroconductive metal oxide such as a tin oxide, a titanium oxide, a antimony oxide, an indium oxide, potassium titanate, an antimony oxide-tin oxide complex oxide and an indium oxide-tin oxide complex oxide. The electroconductive metal oxide may be coated with an insulating particulate material such as barium sulfate, magnesium silicate, and calcium carbonate.

It is to be noted that, in the case of a single layered belt formed of uniform materials, the belt pitch line, which determines the belt travel velocity, is located at or around the center thereof in the thickness direction because its inner surface and outer surface have an identical or similar stretch and shrinkage rate, as described above.

By contrast, in the case of the multilayered belt described above, the belt pitch line is not located at or around the center thereof in the thickness direction. When the multilayered belt include a layer whose Young's module is significantly greater than those of other layers, this layer, which is hereinafter referred to as stretch and shrinkage resistant layer, serves as an interlining layer. Then, other layers stretch or shrink, and thus the multilayered belt winds around the support roller. Thus, the belt pitch line is located around the center of the stretch and shrinkage resistant layer.

In the case of the intermediate transfer belt 110 shown in FIG. 12, the fourth layer 110D serves as the stretch and shrinkage resistant layer, and thus the belt pitch line is located therein. When the stretch and shrinkage resistant layer having a greater Young's module is thus included, thickness unevenness of this layer in the circumferential direction significantly affects fluctuation in the PLD. That is, in the multilayered belt, the PLD is determined depending on such a layer having a Young's module greater than those of other layers.

Further, the position of the fourth layer 110D may fluctuate in the thickness direction for an entire circumference of the intermediate transfer belt 110, which also affects the PDF fluctuation. For example, when the thickness of the fifth layer 110E, which is located between the fourth layer 110D and the support roller, is uneven, the position of the fourth layer 110D in the thickness direction fluctuates, and thus the PLD is caused to fluctuate.

Moreover, in the case of an endless belt having a seam (seam belt), a typical method of manufacturing the intermediate transfer belt 110 is as follows: First a polyvinylidene sheet to be used as the fourth layer 110D is formed, and then about 2-mm edge portions thereof are overlaid with each other, melted, and bonded together as a seam, forming an endless sheet. Then, other layers are sequentially formed on the fourth layer 110D.

In the method described above, elasticity of the bonded portion (seam) is different from those of other portions due to changes in properties caused by melting, and accordingly the bonded portion can have a PLD significantly different from that of other portions even if thickness thereof are identical.

Consequently, in such a case, the PLD fluctuates even if the belt thickness does not fluctuate, and the belt travel velocity fluctuates when the portion whose PLD is different from that of other portions is on the driving roller.

It is to be noted that, although a mold is required for each circumferential length to manufacture seamless belts having different circumferential lengths, in the case of the seam belt, molds are not required and circumferential length can be freely adjusted, and thus the manufacturing cost can be reduced.

In the image forming apparatus 100 shown in FIG. 10 according to the present embodiment, although the intermediate transfer belt 110 should travel at a constant velocity, the belt travel velocity can fluctuate due to shape and assembly error of its components, environment conditions, and changes over time in practical operation.

If the travel velocity of the intermediate transfer belt 110 fluctuates, an actual travel position is different from a target position, and thus leading edge portions of the respective toner images on the photoreceptors 40 will be transferred onto different portions of the intermediate transfer belt 110, resulting in color deviation. Further, a portion of the toner image that is transferred onto the intermediate transfer belt 110 when the belt travel velocity is relatively high will be enlarged in the circumferential direction. By contrast, a portion of the toner image that is transferred onto the intermediate transfer belt 110 when the belt travel velocity is relatively low will be reduced in the circumferential direction. In this case, the resulting image formed on the recording medium has periodic changes in image density in the circumferential direction of the intermediate transfer belt 110, which is a type of image failure called banding.

In view of the foregoing, in the preset embodiment, the roller 150 is located to face the support roller 114 via the intermediate transfer belt 110 as shown in FIG. 11, and travel of the belt is controlled so as to minimize fluctuations in the travel velocity or travel distance based on the rotational angular displacements or the rotational angular velocities of the support roller 116 and the roller 150 similarly to the embodiments described above with reference to FIGS. 1 and 4. Thus, the travel velocity of the intermediate transfer belt 110 can be kept at a constant velocity with a relatively higher level of accuracy.

Another example of the image forming apparatus to which the present invention is applied is described below with reference to FIGS. 13 and 14.

Figure 13:
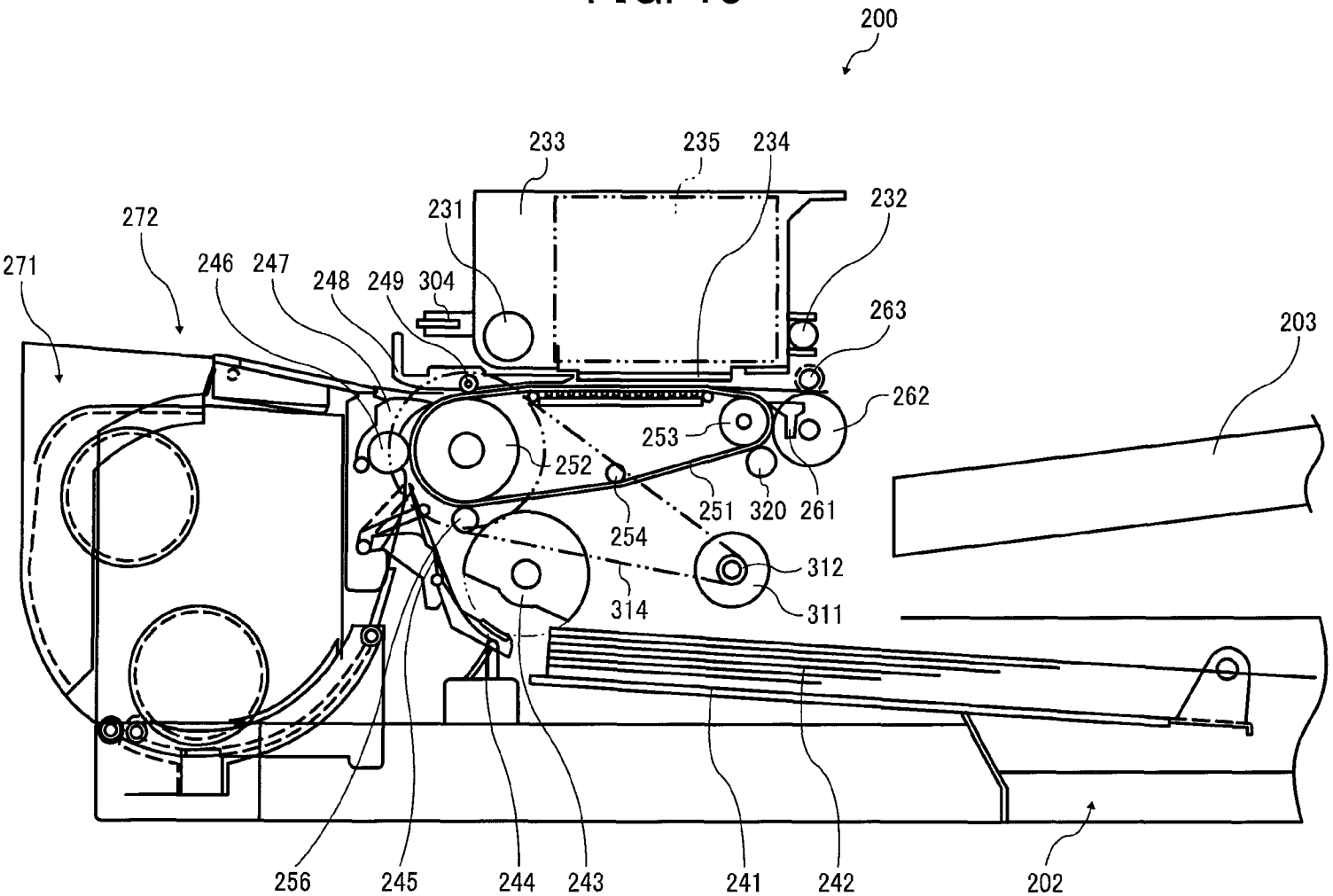
FIG. 13 schematically illustrates another example of the image forming apparatus.
Figure 14:
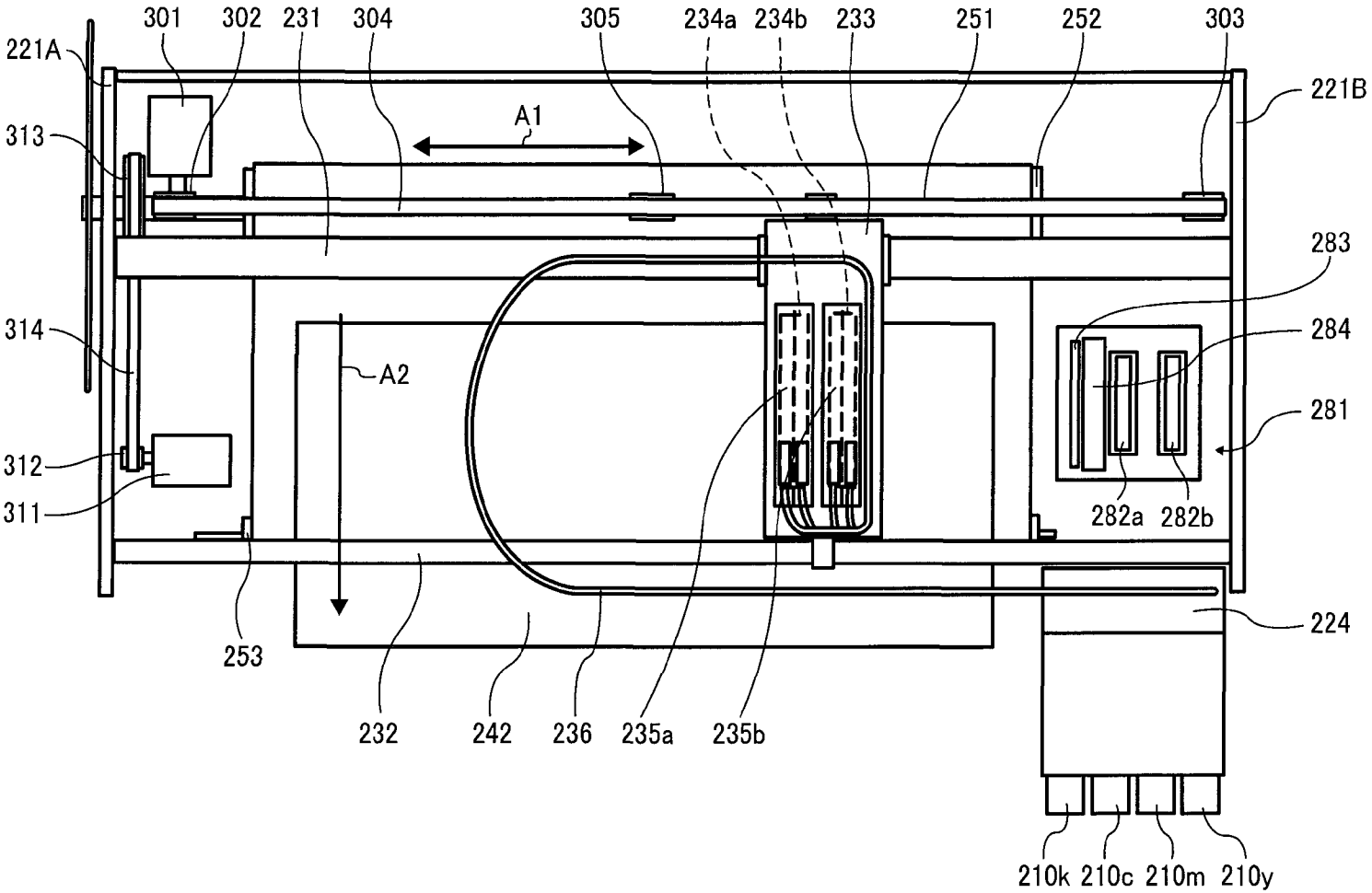
FIG. 14 is a plan view illustrating the image forming apparatus shown in FIG. 13.

FIG. 13 illustrates a schematic configuration of a serial-type inkjet image forming apparatus, and FIG. 14 is a plan view illustrating a main part thereof. In FIG. 14, reference characters A1 represent a carriage main scanning direction and A2 represents a sub-scanning direction or belt transport direction.

As shown in FIG. 13, the inkjet image forming apparatus includes a carriage 233 that is supported by guide rods 231 and 232 slidably in the main scanning direction and a timing belt 304 via which the carriage 233 travels in the main scanning direction. As shown in FIG. 14, the carriage 233 includes recording heads or droplet ejection heads 234*a* and 234*b* and sub tanks 235*a* and 235*b*. The recording heads 234*a* and 234*b* are attached to the carriage 233 so as to eject ink droplets downward in FIG. 13 and respectively include two nozzle lines for ejecting ink droplets in which multiple nozzles are arranged in the sub-scanning direction, which is perpendicular to the main scanning direction.

It is to be noted that the recording heads 234*a* and 234*b* and the sub tanks 235*a* and 235*b* are hereinafter simply referred as the recording heads 234 and sub tanks 235, respectively, when discrimination therebetween is not required.

One of the nozzle lines of the recording head 234*a* ejects black droplets and the other nozzle line ejects cyan droplets, and one of the nozzle lines of the recording head 234*b* ejects magenta droplets and the other nozzle line ejects yellow droplets.

It is to be noted that, although the description above concerns a configuration to eject four color ink droplets using two recording heads, alternatively, a recording head can be provided for each color, or a single recording head including a nozzle line in which multiple nozzles for ejecting four color ink droplets are arranged can be used.

The sub tanks 235 supply the recording heads 234 with black, cyan, magenta, and yellow inks corresponding to the color of the droplets ejected from the respective nozzle lines.

Referring to FIG. 14, the inkjet image forming apparatus further includes right and left side plates 221A and 221B which the guide rods 231 and 232 lay across, a main scanning motor 301, and a supply unit 224. The timing belt 304 is looped around a driving pulley 302 serving as a rotary support member, a driven pulley 303, and a tension pulley 305 that tensions the timing belt 304, and the main scanning motor 301 drives the carriage 233 to travel in the mains scanning direction indicated by arrow A1. The supply unit 224 supplies the sub tank 235*s* with respective color inks from ink cartridges 201*k*, 210*c*, 210*m*, and 210*y* through a supply tube 236.

Referring to FIG. 13, the inkjet image forming apparatus further includes a sheet feed tray 202 including a sheet stack part or pressure plate 241 on which sheets 242 (recording media) are stacked, a semilunar feed roller 243 to feed the sheets 242, and a separation pad 244 facing the semilunar roller 243.

The separation pad 244 includes a material whose frictional coefficient is relatively large and is pressed to the side of the feed roller 243 so that the sheets 242 are fed one by one. The sheet 242 is then guided to a transport belt 251 by a guide 245, a counter roller 246, a transport guide 247, and a pressure member 248 provided with an edge pressure roller 249. The transport belt 251 electrostatically absorbs and transports the sheet 242 to a position facing the recording heads 234.

As shown in FIG. 13, the transport belt 251 is an endless belt looped around a transport roller 252 serving as a rotary support member, a driven roller 253, and a tension roller 254 to tension the transport belt 251 and rotationally travels in the sub-scanning direction, which is also referred to as the belt transport direction. The driven roller 253 faces a roller 302 via the transport belt 251.

The transport belt 251 is provided with a charge roller 256 configured to contact and charge an outer surface of the transport belt and to be rotated by rotation of the transport belt 251. As shown in FIGS. 13 and 14, a timing belt 314 is looped around a timing pulley 312 and a timing pulley 313 attached to a shaft of the transport roller 252. The transport roller 252 is rotated by a sub-scanning motor 311 via the timing belt 314, which rotates the transport belt 251 in belt transport direction indicated by arrow A2.

Further, as shown in FIG. 13, the inkjet image forming apparatus further includes a separation claw 261 to separate the sheet 242 from the transport belt 251, a discharge rollers 262 and 263, and a discharge tray 203 located beneath the discharge roller 262.

Referring to FIG. 13, a double-printing unit 271 is detachably attached to a back side of the inkjet image forming apparatus. For duplex-printing, the sheet 242 can be sent back by reverse rotation of the transport belt 251, and then the duplex-printing unit 271 draws the sheet 242 thereinto so as to reverses and forward the sheet 242 to between the counter roller 246 and the transport belt 251. An upper surface of the duplex-printing unit 272 serves as a manual feed tray 272.

Referring to FIG. 14, the inkjet image forming apparatus further includes a carriage restoration unit 281 located in a non-image area on one side in the main scanning direction indicated by arrow A1 and configured to maintain and restore conditions of the nozzles of the recording heads 234. The carriage restoration unit 281 includes caps 282*a* and 282*b* to respectively cover surfaces of the nozzles of the recording heads 234*a* and 234*b*, a wiper blade 283 to wipe the surfaces of the nozzles, and a waste droplet receiver 284 to receive discarded droplets. When viscosity of recording liquid (ink) is increased, the recording heads 234 eject such thick recording liquid, which the waste droplets receiver 284 receives. Further, another waste droplet receiver may be provided in a non-image area on the other side in the main scanning direction.

Operation of the inkjet image forming apparatus configured as described above is described below.

The sheet 242 is fed from the sheet feed tray 202 upward in a substantially vertical direction in FIG. 13 and then sandwiched between the transport belt 251 and the counter roller 246, guided by the guide 245. Further, a leading edge thereof is guided by the transport guide 247 and then pressed against the transport belt 251 by the edge pressure roller 249, and thus a transport direction of the sheet 242 is turned about 90 degrees.

While the sheet 242 is thus feed, an alternating voltage, in which a positive output and a negative output alternate, is applied to the charge roller 256, forming a positively charged zone and a negatively charged zone that have a predetermined or given width and alternate on the transport belt 251 in the circumferential direction, that is, the sub-scanning direction.

When the sheet 242 is forwarded to the transport belt 251 having alternating zones of positive charge and negative charge, the transport belt 251 absorbs the sheet 242, and then the sheet 242 is transported in the sub-scanning direction by rotation of the transport belt 251.

Then, while the carriage 233 is moving, ink droplets are ejected onto the sheet 242 that is not moving, forming an image by one line by driving the recording heads 234 according to image signals. Subsequently, the sheet 242 is transported for a given distance, and then a subsequent line is recorded thereon. When a signal indicating recording completion or arrival of a trailing edge of the sheet 242 at a recording area is output, image recording operation is completed and the sheet 242 is discharged onto the discharge tray 203.

In this inkjet image forming apparatus, it is necessary to control travel of the transport belt 251 accurately because positional deviation, image density unevenness, and color deviation will be caused if travel distance of the transport belt 251 fluctuates while transporting the sheet 242. Similarly, it is necessary to control travel of the timing belt 314 accurately because positional deviation and image density unevenness will be caused if travel velocity of the carriage 233 fluctuates while the carriage 233 scans in the main scanning direction.

The transport belt 251 and its driving control are described below in further detail.

For example, the transport belt 251 is a single-layered belt mainly including polyimide (PI), and its thickness is not constant for an entire circumference, which causes the PLD to fluctuate while the transport belt 251 travels.

Therefore, a rotary encoder (wheel encoder) is provided on a shaft of the driven roller 253 around which the transport belt 251 is looped, and rotational angular velocity or rotational angular displacement of the driven roller 253 is detected. Further, the roller 320 is provided to face the driven roller 253 via the transport belt 251, and another rotary encoder (wheel encoder) is provided on a shaft of the roller 320 so as to detect rotational angular velocity or rotational angular displacement of the roller 320.

It is to be noted that the rotary encoders are located on the opposite sides in a roller axial direction and have sufficiently large diameters, such as about four times as large as those of the shafts of the rollers to which the rotary encoders respectively attached. Further, a ratio of a radius of the driven roller 253 and that of the roller 320 is 7 to 3, as an example, so as to prevent respective AC components from interfering with each other during frequency breakdown. When such a ratio of prime numbers is used, interference among waves can be prevented, which facilitates extraction of the fluctuation components described in the embodiment described with reference to FIG. 4.

Because the rotational angular velocities of the driven roller 253 and the roller 230 can be obtained, the transport belt 251 can be controlled to travel at a desired velocity or a desired distance based on the rotational angular velocities $\omega_1$ and $\omega_2$ of the driven roller 253 and the roller 230, similarly to the embodiment described with reference to FIG. 4.

It is to be noted that, although the description above concerns control of the transport belt 251, the present invention can be applied to the timing belt 304 as well.

Further, although the description above concerns the serial type inkjet image forming apparatus, similar results can be achieved by applying the present invention to a line type inkjet image forming apparatus, in which nozzles are arranged to cover a sheet width in the sheet width direction that is perpendicular to a direction in which the sheet is transported.

The timing belt 304 and its driving control are described below in further detail with reference to FIGS. 14 and 15.

For example, the timing belt 304 is a toothed endless belt including polyurethane and has a circumferential length of 1.2 m and a width of 15 mm. The timing belt 304 is provided with 300 teeth, and three 1-mm wire ropes bound together as a stretch prevention member are provided therein along a circumferential direction thereof. The driving pulley 302 is a toothed pulley including 18 teeth, and the driven pulley 303 is a toothed pulley including 27 teeth.

It is to be noted that the tension pulley 305 may be omitted by configuring the driven pulley 303 to tense the timing pulley 304. However, in a configuration in which a roller serving as the driven rotary member is provided to face the driven pulley 303 via the timing belt 304, if the driven pulley 303 to which a rotary encoder is attached is configured to tense the timing belt 304, error in rotational detection can be caused by displacement of the driven pulley 303 due to the tension. Thus, using the tension pulley 305 is preferable in such a configuration.

A PLD of the timing belt 304 fluctuates due to positional error of the wire ropes in the production of the timing belt 304, an uneven thickness of the polyurethane rubber caused by error of a mold, etc.

Figure 15:
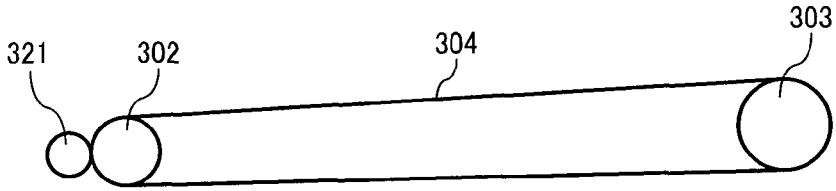
FIG. 15 schematically illustrates a belt unit to move a carriage included in the image forming apparatus shown in FIG. 13 in a main scanning direction.
Figure 16:
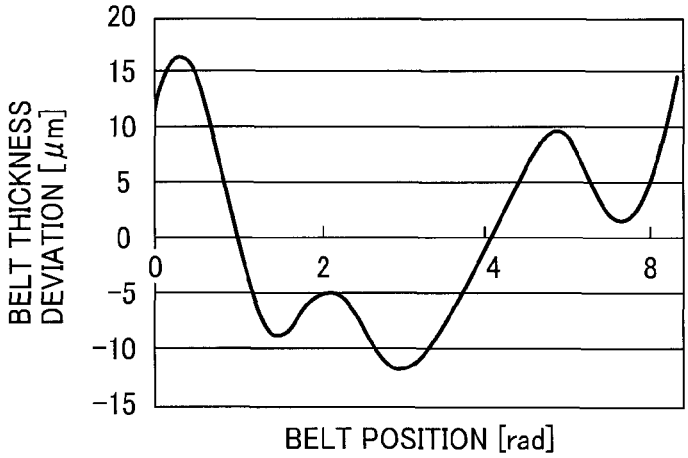
FIG. 16 RELATED ART
FIG. 16 illustrates an example of unevenness of a thickness of a known single-layered belt.
Figure 17:
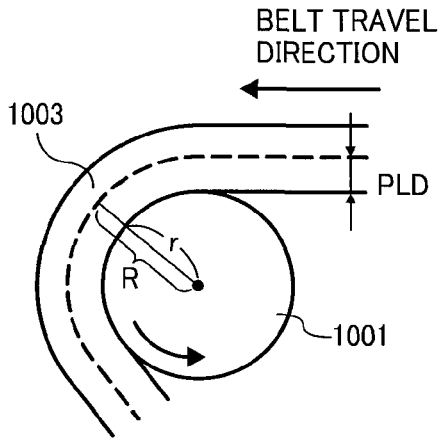
FIG. 17 RELATED ART
FIG. 17 illustrates a portion of a known belt unit in which a belt is wound around a driving roller.

In view of the foregoing, a roller 321 is provided to face the driving pulley 302 via the timing belt 304 as shown in FIG. 15, and rotational angular velocity or displacement of the driving pulley 302 is detected by a rotary encoder provided on a shaft of the driving pulley 302 or a rotation detector provided in the main scanning motor 301. Further, another rotary encoder is provided on a shaft of the roller 321 so as to detect rotational angular velocity or displacement of the roller 321. In this case, by providing the roller 321 that presses the timing belt 304 against the driving pulley 302, the tooth of the timing belt 304 can be prevented from disengaging from those of the driving pulley 302. This mechanism can also be applied to any combination of a driving roller and a roller facing that driving roller via a belt so as to efficiently prevent slippage of the belt.

Further, a ratio of a radius of the driven pulley 302 and that of the roller 321 is 57 to 23, as an example, so as to prevent respective AC components from interfering with each other during frequency breakdown. When such a ratio of relatively large prime numbers is used, interference among waves can be prevented, which facilitates extraction of the fluctuation components described in the embodiment described above.

Because the rotational angular velocities of the driving pulley 302 and the roller 321 can be obtained, the timing belt 304 can be controlled to travel at a desired velocity or a desired distance based on the rotational angular velocities $\omega_1$ and $\omega_2$ of the driving pulley 302 and the roller 321, similarly to the embodiment described above.

Numerous additional modifications and variations are possible in light of the above teachings. It is therefore to be understood that, within the scope of the appended claims, the disclosure of this patent specification may be practiced otherwise than as specifically described herein.

This patent specification claims priority from Japanese Patent Application Nos. 2007-237644, filed on Sep. 13, 2007 and 2008-229663, filed on Sep. 8, 2008 in the Japan Patent Office, the entire contents of which are hereby incorporated by reference herein.

What is claim is:

1. An image forming apparatus for forming an image on a recording medium, comprising:

a belt configured to travel rotationally, looped around at least two rotary support members;

a driven rotary member disposed facing at least one of the rotary support members via the belt and configured to be driven to rotate by the belt; and a controller configured to minimize fluctuation in one of a travel velocity and a travel distance of the belt by controlling the travel of the belt based on one of a rotational angular displacement and a rotational angular velocity of each of the rotary support member and the driven rotary member, wherein the recording medium contacts the outer surface of the belt without passing through between the driven rotary member and the rotary support member, and wherein the controller is configured to determine both an inner surface travel velocity of the belt and an outer surface travel velocity of the belt based on said one of the rotational angular displacement and the rotational angular velocity of each of the rotary support member and the driven rotary member, calculate one of a belt travel velocity function and a belt travel distance function based on the inner surface travel velocity of the belt and the outer surface travel velocity of the belt, and control the travel of the belt to minimize fluctuation in said one of the belt travel velocity function and the belt travel distance function.

2. The image forming apparatus according to claim 1, wherein the rotary support members contact an inner surface of the belt, and the driven rotary member contacts an outer surface of the belt.

3. The image forming apparatus according to claim 1, wherein a ratio of a radius of the driven rotary member and a radius of the one of the rotary support members is a ratio of prime numbers.

4. A belt unit comprising:

a belt configured to travel rotationally, looped around at least two rotary support members;

a driven rotary member disposed facing at least one of the rotary support members via the belt, configured to be driven to rotate by the belt; and a controller configured to minimize fluctuation in one of a travel velocity and a travel distance of the belt caused by fluctuation in belt thickness by controlling the travel of the belt based on one of a rotational angular displacement and a rotational angular velocity of each of the rotary support member and the driven rotary member, and wherein the controller is configured to determine both an inner surface travel velocity of the belt and an outer surface travel velocity of the belt based on said one of the rotational angular displacement and the rotational angular velocity of each of the rotary support member and the driven rotary member, calculate one of a belt travel velocity function and a belt travel distance function based on the inner surface travel velocity of the belt and the outer surface travel velocity of the belt, and control the travel of the belt to minimize fluctuation in said one of the belt travel velocity function and the belt travel distance function.

5. The belt unit according to claim 4, further comprising a fluctuation information storage unit configured to store rotational fluctuation information, wherein the controller evaluates the rotational fluctuation information regarding a time period required for the belt to make at least one rotation.

6. The belt unit according to claim 5, wherein the rotational fluctuation information stored in the fluctuation information storage unit is information about the driven rotary member when the belt is rotated with one of the rotational angular displacement and the rotational angular velocity of the rotary support member kept constant.

7. The belt unit according to claim 5, wherein the rotational fluctuation information stored in the fluctuation information storage unit is information about the rotary support member when the belt is rotated with the rotational angular displacements or the rotational angular velocity of the driven rotary member kept constant.

8. The belt unit according to claim 5, wherein the controller extracts an AC component whose period corresponds to one rotation of the rotary support member from the rotational fluctuation information, corrects information about one of the rotational angular displacement and the rotational angular velocity of the rotary support member, and minimizes fluctuation in one of the travel velocity and the travel distance of the belt caused by the fluctuation in rotation of the rotary support member.

9. The belt unit according to claim 5, wherein the controller extracts an AC component whose period corresponds to one rotation of the driven rotary member from the rotational fluctuation information, corrects information about one of the rotational angular displacement and the rotational angular velocity of the driven rotary member, and minimizes fluctuation in one of the travel velocity and the travel distance of the belt caused by the fluctuation n rotation of the driven rotary member.

10. The belt unit according to claim 5, wherein the controller extracts AC components whose periods respectively correspond to one rotation of the rotary support member and the driven rotary member and are different from each other from the rotational fluctuation information, corrects information about one of the rotational angular displacement and the rotational angular velocity of at least one of the rotary support member and the driven rotary member, and minimizes fluctuation in one of the travel velocity and the travel distance of the belt caused by the fluctuation in rotation of at least one of the rotary support member and the driven rotary member.

11. The belt unit according to claim 5, wherein the controller extracts an AC component whose period corresponds to one rotation of at least one of the rotary support member and the driven rotary member from the rotational fluctuation information, evaluates fluctuation in the travel velocity of the belt by deducting the extracted AC component from the rotational fluctuation information, corrects information about one of the rotational angular displacement and the rotational angular velocity of the rotary support member, and minimizes fluctuation in one of the travel velocity and the travel distance of the belt caused by the belt,

12. The belt unit according to claim 5, wherein the controller performs a first evaluation of the rotational fluctuation information at a predetermined timing.

13. The belt unit according to claim 5, wherein the belt is used to transport the recording medium, and the controller evaluates the rotational fluctuation information in a time period when the belt does not transport the recording medium.

14. An image forming apparatus for forming an image on a recording medium comprising the belt unit according to claim 4.

15. The belt unit according to claim 4, wherein the rotary support members contact an inner surface of the belt, and the driven rotary member contacts an outer surface of the belt.

16. A belt unit comprising:

a belt configured to travel rotationally, looped around at least two rotary support members;

a driven rotary member disposed facing at least one of the rotary support members via the belt, configured to rotate with the belt;

a controller configured to minimize fluctuation in one of a travel velocity and a travel distance of the belt by controlling the travel of the belt based on one of a rotational angular displacement and a rotational angular velocity of each of the rotary support member and the driven rotary member; and a fluctuation information storage unit configured to store rotational fluctuation information, wherein the controller performs, at a predetermined timing, a first evaluation of the rotational fluctuation information regarding a time period required for the belt to make at least one rotation, and when a difference between the rotational fluctuation information stored in the fluctuation information storage unit and the rotational fluctuation information evaluated at the predetermined timing exceeds a predetermined allowable range, the controller performs a second evaluation of the rotational fluctuation information.

17. The belt unit according to claim 16, wherein, in the second evaluation of the rotational fluctuation information, the controller stores the rotational fluctuation information regarding a time period longer than a time period of the first evaluation of the rotational fluctuation information in the fluctuation information storage unit.

18. An image forming apparatus for forming an image on a recording medium comprising the belt unit according to claim 16.

* * * * *